US012752991B2

(12) United States Patent
Kohn et al.

(10) Patent No.: US 12,752,991 B2
(45) Date of Patent: Oct. 6, 2026

(54) HEMP PAPER BAGS

(71) Applicants: Steve Kohn, Short Hills, NJ (US); Luis DeOliveira, Lanoka Harbor, NY (US); James Cottrell, II, Rock City Falls, NY (US); Josh Cottrell, Rock City Falls, NY (US)

(72) Inventors: Steve Kohn, Short Hills, NJ (US); Luis DeOliveira, Lanoka Harbor, NY (US); James Cottrell, II, Rock City Falls, NY (US); Josh Cottrell, Rock City Falls, NY (US)

(73) Assignee: BROADWAY HOLDINGS XI, LLC, Monroe, NJ (US)

( * ) Notice: Subject to any disclaimer, the term of this patent is extended or adjusted under 35 U.S.C. 154(b) by 0 days.

(21) Appl. No.: 18/669,107

(22) Filed: May 20, 2024

(65) Prior Publication Data

US 2024/0308743 A1 Sep. 19, 2024

Related U.S. Application Data

(63) Continuation of application No. 17/855,536, filed on Jun. 30, 2022.

(60) Provisional application No. 63/224,320, filed on Jul. 21, 2021.

(51) Int. Cl.

| | |
|---|---|
| ***B65D 65/46*** | (2006.01) |
| ***B65D 30/18*** | (2006.01) |
| ***B65D 30/20*** | (2006.01) |
| ***B65D 33/00*** | (2006.01) |
| ***B65D 33/04*** | (2006.01) |
| ***B65D 33/10*** | (2006.01) |

(52) U.S. Cl.

CPC ..... *B65D 65/466* (2013.01); *B65D 31/08* (2013.01); *B65D 31/10* (2013.01); *B65D 33/004* (2013.01); *B65D 33/04* (2013.01); *B65D 33/105* (2013.01); *B65D 2565/383* (2013.01); *B65D 2565/385* (2013.01)

(58) Field of Classification Search

CPC ..... D21H 27/10; B65D 65/466
USPC ..... 383/17, 20, 10
See application file for complete search history.

(56) References Cited

U.S. PATENT DOCUMENTS

| | | | | |
|---|---|---|---|---|
| 1,671,050 | A * | 5/1928 | Snyder | B65D 33/02 383/122 |
| 3,565,327 | A * | 2/1971 | Rodley | B65D 33/12 383/20 |
| 6,206,570 | B1 * | 3/2001 | Cortopassi | B65D 33/004 383/111 |
| 2012/0269469 | A1 * | 10/2012 | Long | B65D 33/22 493/189 |
| 2020/0063355 | A1 * | 2/2020 | Everett | D21H 15/04 |
| 2022/0411154 | A1 * | 12/2022 | McLoughlin | B32B 29/005 |

FOREIGN PATENT DOCUMENTS

| | | | | |
|---|---|---|---|---|
| WO | WO-2022271587 | A9 * | 12/2023 | D21C 3/022 |

* cited by examiner

*Primary Examiner* — Nathan J Newhouse
*Assistant Examiner* — Nina K Attel
(74) *Attorney, Agent, or Firm* — Philip M. Weiss; Weiss & Weiss

(57) ABSTRACT

The use of one hundred percent hemp paper for use in paper bags.

16 Claims, 14 Drawing Sheets

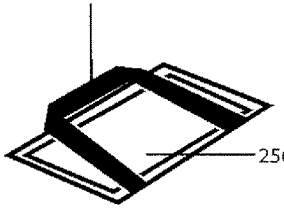
Figure 10d
Figure 10c
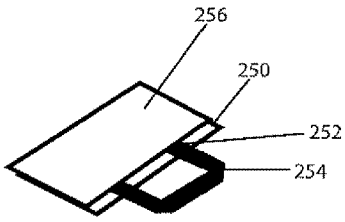
Figure 10b
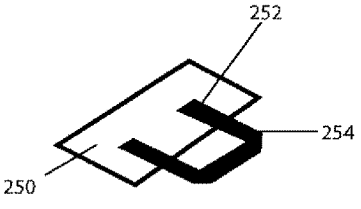
Figure 10a
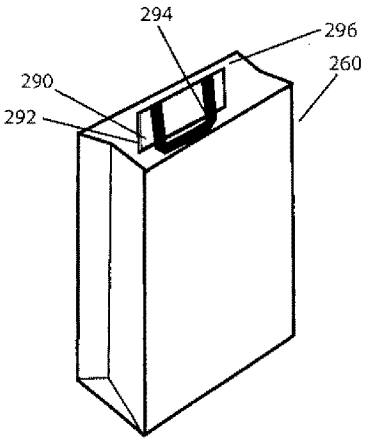
Figure 10h
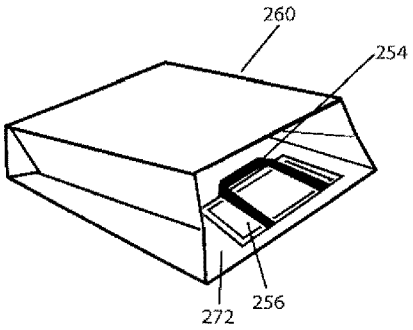
Figure 10g
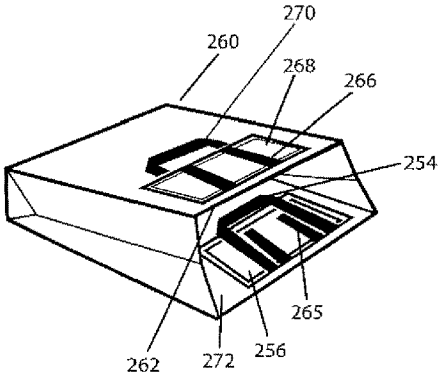
Figure 10f
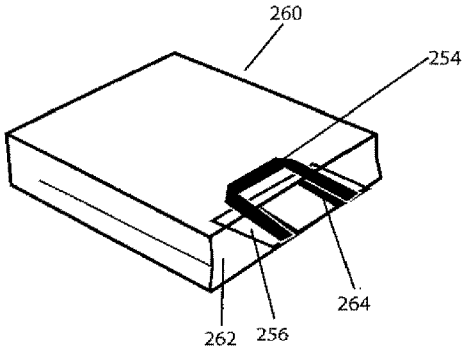
Figure 10e

HEMP PAPER BAGS

RELATED APPLICATIONS

The current application is a continuation of application Ser. No. 17/855,536 filed Jun. 30, 2022 which claims the benefit of and priority to provisional patent application No. 63/224,320 filed Jul. 21, 2021.

FIELD OF THE INVENTION

The use of one hundred percent hemp paper to manufacture bags or newsprint.

BACKGROUND OF THE INVENTION

Hemp is a source of fiber that comes from the plant species *Cannabis sativa*. Hemp can be produced much faster than trees. Hemp stalks grow in four months, whereas trees can take twenty to eighty years. One acre of hemp can yield 1,300 pounds of fiber and produce as much paper as four to ten acres of trees over a twenty year cycle. Unlike trees, hemp plants can be grown without using any pesticides or herbicides. The wider use of hemp plants can reduce deforestation.

The hemp-growing industry is regulated throughout the United States. Recent regulations have sought to encourage this nascent industry as biodegradable hemp raw materials can be turned into biodegradable hemp-based products such as hemp paper. Biodegradable hemp products break down in approximately 90 days versus the dozens of years it takes petroleum-based plastics to break down into microplastics that frequently end up in the ocean.

Hemp plant stalks have two parts. The bast fibers, or outer part of the stalk have a grassy texture and typically contain almost 80% cellulose. The hurd, or inner part of the stalk, has a woody core made up of cellulose-laden bundles of short fiber. The process of separating the bast fiber from the hurd fiber is called decortication. To facilitate decortication, dew retting or water retting is typically done first. Retting uses bacteria and moisture to dissolve away the gummy substances that surround bast fiber bundles.

Hemp paper is a plant based, non-toxic, sustainable alternative to conventional paper made from trees. Hemp paper is primarily made from the bast fibers of hemp plants. Hemp paper has a low lignin and high cellulose content. Hemp paper does not age or discolor with time. The quality of hemp paper is better than that of paper made from the wood pulp of trees. Hemp paper is thin, and lightweight, with a high degree of stiffness. Hemp paper is tough, brittle and rough. Wood pulp paper is softer and thicker than hemp paper. Hemp paper is more difficult to make and is stronger than wood pulp paper. Hemp paper can be recycled up to eight times, compared to just three times for paper made from wood pulp.

U.S. Pat. No. 5,080,702 relates to a disposable two-ply filter for a vacuum cleaner bag, wherein the outer ply may be wood paper, hemp paper or any other filter paper, cloth or fabric well known in the art.

U.S. Pat. No. 5,700,599 relates to a high absorption rate battery separator of a non-woven cellulosic substrate coated on at least one surface with a cellulosic film and a process for making such separator by contacting a nonwoven cellulosic textile substrate with a cellulose or cellulose derivative solution on at least one side of the substrate. Preferred nonwovens are paper webs such as hemp paper bonded with hydrogen bonds, cellulose or food grade binders.

U.S. Pat. No. 7,537,514 relates to a double casing with netting for food products, wherein the material of the tube comprises a combination of materials selected from the group consisting of edible collagen of bovine or porcine origin, inedible collagen, regenerated collagen, regenerated or fibrous collagen, plastic material, hemp paper, any type of paper, and a polysaccharide.

U.S. Pat. No. 7,666,484 relates to a ready to use food packaging film, wherein in one embodiment the film is made out of hemp paper.

U.S. Pat. No. 5,744,251 relates to a cellulosic composition and article. Fibrous casing made in the casing industry is produced by coating regenerated cellulose onto a sheet or tube of hemp paper.

US patent publication 20190280135 relates to a room temperature printing method for producing a PV layer sequence. The process is characterized in that the carrier used for the PV layer sequence comprises continuous, flat sheets of material, preferably sheets of film and/or sheets of paper, more preferably sheets of hemp paper. Hemp offers the advantage that it can be manufactured in a sulfate-free manner; provided with additional moisture inhibitor and/or biocide, such as hemp paper can advantageously withstand high temperatures without yellowing or significant mechanical degradation or any decline in its properties.

SUMMARY OF THE INVENTION

The present invention relates to a bag that is comprised of hemp paper. The definition of hemp paper includes machine made hemp paper. The present invention relates to a bag that is comprised of hemp paper made from one hundred percent hemp. It is an object of the present invention for the remaining percentage of paper that is not hemp paper to be made from any combination of post-consumer waste recycled content wood pulp, post-industrial recycled content wood pulp, virgin wood pulp, preservatives, chemicals and additives.

It is an object of the present invention for the hemp paper to have a hurd content of less than 15%. It is an object of the present invention for the hemp paper to have a hurd content of less than 10%. It is preferred that the hemp paper to have a hurd content of 5% or less. It is an object of the present invention for the hemp paper that is not made from the hurd of the hemp stalk to be made from the bast fiber of the hemp stalk. It is an object of the present invention for the hemp paper to be made only from 95% bast fiber and 5% hurd fiber. It is an object of the present invention for hemp paper to be made from some combination of hemp hurd, hemp bast fiber, post-consumer recycled content wood pulp and post-industrial recycled content wood pulp. It is an object of the present invention for hemp paper to be made from some combination of hemp hurd, hemp bast fiber, post-consumer recycled content wood pulp, post-industrial recycled content wood pulp, preservatives, chemicals and additives. It is an object of the present invention to use as low a hurd content percentage as possible to increase the strength of hemp paper. It is an object of the present invention to make hemp paper without using any clay, fillers, chemicals or additives. It is an object of the present invention to make hemp paper by using some clay, fillers or chemicals or additives.

It is an object of the present invention to harvest hemp plants to make hemp paper. It is an object of the present invention to genetically modify hemp plants so that they do not comprise THC or CBD compounds. It is an object of the present invention to harvest genetically modified hemp plants that do not comprise THC or CBD compounds and make hemp paper from those plants.

Tensile strength refers to the maximum stress needed to break a strip of paper sheet. Tensile strength is measured in two directions-machine direction, commonly abbreviated as MD, and cross direction, commonly abbreviated as CD. Cross direction is also referred to as transverse direction, commonly abbreviated as TD. MD means the direction that the paper web runs on a paper machine, while CD means the direction perpendicular to MD. It is an object of the present invention that hemp paper has a tensile MD strength ranging from five pounds to two hundred pounds per inch, preferably from twenty pounds to one hundred pounds per inch. It is an object of the present invention that hemp paper has a tensile CD strength ranging from five pounds to two hundred pounds per inch, preferably from twenty pounds to one hundred pounds per inch. It is an object of the present invention that hemp paper has a MD strength greater than CD strength. It is an object of the present invention that hemp paper has a MD strength greater than or equal to CD strength.

Bursting strength refers to the maximum pressure required to rupture a paper surface or sheet. It is an object of the present invention that hemp paper has a bursting strength ranging from five pounds to two hundred pounds per square inch (PSI), preferably from twenty pounds to one hundred twenty pounds per square inch.

Elongation percentage refers to the stretch required to rupture a paper sheet. Elongation percentage is measured in two directions-machine direction, commonly abbreviated as MD, and cross direction, commonly abbreviated as CD. It is an object of the present invention that hemp paper has an elongation MD percentage ranging from one half to twenty pounds per inch, preferably from two pounds to ten pounds per inch. It is an object of the present invention that hemp paper has an elongation CD percentage ranging from one half pound to twenty pounds per inch, preferably from two pounds to ten pounds per inch. It is an object of the present invention that hemp paper has more stretch built into it in both MD and CD directions than wood pulp paper. It is an object of the present invention that the greater MD and CD stretch percentages allow hemp paper to fold without the risk of cracking.

It is an object of the present invention that hemp paper be treated or coated with AKD sizing, a wax derivative. It is an object of the present invention to use AKD sizing as a preventative measure to reduce the level of curling in the hemp paper so that the hemp paper will lay flat on a surface.

It is an object of the present invention that hemp paper be brown in color, commonly called unbleached or kraft. It is an object of the present invention that hemp paper be white in color, commonly called bleached. It is an object of the present invention for the hemp paper bag to be comprised of bleached hemp paper. It is an object of the present invention for the hemp paper bag to be of a color other than white or brown. It is an object of the present invention to use non-toxic bleaching to whiten hemp paper. It is an object of the present invention that hemp paper used to make paper bags and packaging products be whitened with hydrogen peroxide during the bleaching process.

It is an object of the present invention that a bag is comprised from hemp paper containing or coated with an anti-microbial or anti-fungal agent to inhibit the growth of mold, mildew and fungus. It is an object of the present invention for the hemp paper bag to be treated with an anti-microbial compound.

It is an object of the present invention that the hemp paper is comprised of an odor control agent to inhibit odors from bacterial growth. It is an object of the present invention that the hemp paper contains an odor-neutralizing agent or is treated with an odor neutralizing agent. It is an object of the present invention that the hemp paper contains or is coated with a fragrance agent.

It is an object of the present invention that the hemp paper comprise a single-ply paper sheet. It is an object of the present invention that the hemp paper comprise a double-ply paper sheet.

It is an object of the present invention for a pinch bottom bag to be made from hemp paper. A pinch bottom hemp paper bag comprises a tubular envelope closed at one end by a single glued flap. It is an object of the present invention for the pinch bottom hemp paper bag to have side gussets. It is an object of the present invention for the pinch bottom hemp paper bag to not have any side gussets.

It is an object of the present invention for the pinch bottom hemp paper bag with or without side gussets to be between two inches and thirty-five inches in height, preferably between four inches and twenty inches in height. It is an object of the present invention for the pinch bottom hemp paper bag with or without side gussets to be between two inches and thirty inches in width, preferably between three inches and twenty inches in width.

It is an object of the present invention for the pinch bottom hemp paper bag with no side gussets to be between three inches to five inches in width and eleven inches to thirteen inches in height. It is an object of the present invention for the pinch bottom hemp paper bag with no side gussets to be between three inches to six inches in width and two inches to six inches in height. It is an object of the present invention for the pinch bottom hemp paper bag with no side gussets to be between two inches to six inches in width and nine inches to eleven inches in height. It is an object of the present invention for the pinch bottom hemp paper bag with no side gussets to be between five inches to seven inches in width and five inches to seven inches in height. It is an object of the present invention for the pinch bottom hemp paper bag with no side gussets to be between four inches to seven inches in width and seven inches to eleven inches in height. It is an object of the present invention for the pinch bottom hemp paper bag with no side gussets to be between five inches to eight inches in width and eight inches to eleven inches in height. It is an object of the present invention for the pinch bottom hemp paper bag with no side gussets to be between six inches to ten inches in width and ten inches to thirteen inches in height. It is an object of the present invention for the pinch bottom hemp paper bag with no side gussets to be between nine inches to eleven inches in width and nine inches to eleven inches in height. It is an object of the present invention for the pinch bottom hemp paper bag with no side gussets to be between nine inches to twelve inches in width and ten inches to fourteen inches in height. It is an object of the present invention for the pinch bottom hemp paper bag with no side gussets to be between eleven inches to sixteen inches in width and fourteen inches to twenty inches in height.

It is an object of the present invention for the pinch bottom hemp paper bags to have side gussets ranging from one quarter of an inch to ten inches wide. It is an object of the present invention for the pinch bottom hemp paper bags with side gussets to have side gussets ranging from one quarter of an inch to three inches wide, widths ranging from three inches to five inches wide, and lengths ranging from nine inches to thirteen inches long. It is an object of the present invention for the pinch bottom hemp paper bags with side gussets to have side gussets ranging from half of an inch to three inches wide, widths ranging from three inches to seven inches wide, and lengths ranging from five inches to ten inches long. It is an object of the present invention for the pinch bottom hemp paper bags with side gussets to have side gussets ranging from one and a quarter inches to four inches wide, widths ranging from eight inches to eleven inches wide, and lengths ranging from fourteen inches to sixteen inches long. It is an object of the present invention for the pinch bottom hemp paper bags with side gussets to have side gussets ranging from a one and a quarter inches to four inches wide, widths ranging from two inches to seven inches wide, and lengths ranging from six inches to eighteen inches long. It is an object of the present invention for the pinch bottom hemp paper bags with side gussets to have side gussets ranging from one and a quarter inches to four inches wide, widths ranging from three inches to nine inches wide, and lengths ranging from twelve inches to thirty inches long. It is an object of the present invention for the pinch bottom hemp paper bags with side gussets to have side gussets ranging from two inches to five inches wide, widths ranging from eleven inches to eighteen inches wide, and lengths ranging from seventeen inches to twenty-five inches long. It is an object of the present invention for the pinch bottom hemp paper bags with side gussets to have side gussets ranging from five inches to nine inches wide, widths ranging from twenty inches to twenty-five inches wide, and lengths ranging from twenty-five inches to thirty two inches long.

It is an object of the present invention for the pinch bottom hemp paper bag to be used to hold utensils such as any combination of knives, forks, and spoons. It is an object of the present invention for the pinch bottom hemp paper bags designed to hold utensils to have widths ranging from two inches to four inches wide and lengths ranging from eight inches to twelve inches long. It is an object of the present invention for the pinch bottom hemp paper bag to be used to hold individual place settings of any combination of knives, forks, and spoons. It is an object of the present invention for each individual place setting that is in the pinch bottom hemp paper bag to be in a sterile environment. It is an object of the present invention for the pinch bottom hemp paper bag for utensils to have side gussets. It is object of the present invention for the side gussets having a range from one quarter of an inch to two inches includes width and lengths ranging from eight inches to twelve inches long.

The dimensions of the pinch bottom hemp paper bags are applicable for merchandise or other goods.

It is an object of the present invention for the pinch bottom hemp paper bags to have multiple uses such as sandwich bags, bread bags, window bread bags, chicken bags, pickle bags, taco bags, french fry bags, food storage bags, sub bags, deli bags, pharmacy bags and sanitary disposal bags.

It is an object of the present invention for the pinch bottom hemp paper bags to hold liquor bottles in half pint, pint, liter and quart bag sizes. It is an object of the present invention for the pinch bottom hemp paper bags designed to hold liquor bottles to have widths ranging from three inches to six inches wide, side gussets ranging from one quarter of an inch to three and half inches wide, and lengths ranging from three inches to eighteen inches long. It is an object of the present invention for the pinch bottom hemp pint sized paper bags to have widths ranging from three inches to five inches wide, side gussets ranging from one and a half inches to two and three quarter inches wide, and lengths ranging from ten inches to thirteen inches long. It is an object of the present invention for the pinch bottom hemp quart sized and liter sized paper bags to have widths ranging from three and a half inches to five and a half inches wide, side gussets ranging from one and a half inches to three and a half inches wide, and lengths ranging from fourteen inches to eighteen inches long.

It is an object of the present invention for the hemp paper bag to hold objects other than food such as moving and storage products or pharmaceutical products. It is an object of the present invention for the hemp paper bag to be used for deliveries of moving and storage products or pharmaceutical products. It is an object of the present invention for the hemp paper bag to hold objects such as alternative medicines, cosmetic products, and health and wellness products.

It is an object of the present invention for the pinch bottom hemp paper bag to have a window similar to that of a window bread bag, so that the contents of the bag are visible from the outside of the bag without having to open the bag. It is an object of the present invention for the pinch bottom hemp paper bags with windows to have widths ranging from three inches to nine inches wide, side gussets ranging from a one and a half inches to four inches wide, and lengths ranging from twelve inches to thirty inches long. It is an object of the present invention for the window to be made of a transparent material. It is an object of the present invention for the window to be made of a transparent paper material. It is an object of the present invention for the window to be made of a flexible plastic material. It is an object of the present invention for the window to be made of glycine.

The present invention relates to a pinch bottom hemp paper bag having gussets with a fold over portion and a closure sticker. It is an object of the present invention for a pinch bottom hemp paper bag to be closed with a closure sticker. It is an object of the present invention for a pinch bottom hemp paper bag to have a top fold over section that folds over the pinch bottom hemp paper bag and is attached to the front of the bag with adhesive that appears after a peel-off adhesive strip or label is removed.

It is an object of the present invention for the pinch bottom hemp paper bag to have an opening. It is an object of the present invention for the pinch bottom hemp paper bag to be closed by folding over a portion of the top of the bag and using a closure mechanism to close the bag. It is an object of the present invention for the closure mechanism to be a sticker. A sticker is defined as a device which has adhesive on one side.

The present invention relates to a pinch bottom hemp paper bag having gussets with an extended back portion, a tab and a slot. The present invention relates to a pinch bottom hemp paper bag having gussets, with an extended back portion, a tab and an adhesive strip. The bag is closed by folding over the extended back portion and attaching the tab to the adhesive. To close the pinch bottom hemp paper bag, the extended back portion is folded over and the tab is inserted into the slot. The present invention relates to a pinch bottom hemp paper bag with an extended back portion, a tab and a closure band. To close the pinch bottom hemp paper bag, the extended back portion is folded over and the tab is inserted into the closure band. The present invention relates to a pinch bottom hemp paper bag having gussets with an extended back portion, a tab and a peel off adhesive. To close the pinch bottom hemp paper bag, the extended back portion is folded over, the peel off strip is removed and the tab is attached to the adhesive.

It is an object of the present invention for the pinch bottom hemp paper bags to have basis weights ranging from five pounds to seventy pounds, preferably from ten pounds to forty pounds. It is an object of the present invention for the pinch bottom hemp paper bag to be able to hold a weight less than fifteen pounds.

It is an object of the present invention for a flat bottom bag to be made from hemp paper. A flat bottom bag comprises a tubular envelope closed at one end by glued flaps that form a flat bottom. It is an object of the present invention for the flat bottom bag to have an opening on one side. It is an object of the present invention for the flat bottom hemp paper bag to have a bottom gusset so that the bag can be opened flat on the bottom. It is an object of the present invention for the flat bottom hemp paper bag to have both bottom and side gussets.

It is an object of the present invention for a hemp paper flat bottom bag to have a bottom that is rectangular in shape. It is an object of the present invention for a hemp paper flat bottom bag to have a bottom that is elliptical in shape. An elliptical shape bottom construction is defined as a bottom with two rounded corners on two opposite sides and two longer opposite sides that begin as straight edges before curving at the ends. It is an object of the present invention for a hemp paper flat bottom bag with handles to have a flat bottom that is elliptical in shape.

It is an object of the present invention for the flat bottom hemp paper bag to be between four inches and twenty inches in height, preferably between five inches and sixteen inches in height. It is an object of the present invention for the flat bottom hemp paper bag to be between one inch and fifteen inches in width, preferably between three inches and twelve inches in width. It is an object of the present invention for the flat bottom hemp paper bags to have bottom gussets ranging from a one inch to twelve inches wide, preferably from one inch to eight inches wide.

It is an object of the present invention for 0.5 lb. flat bottom hemp paper bags to have widths ranging from two inches to four inches wide, gussets ranging from one inch to two and a half inches wide and lengths ranging from five inches to six and a half inches long. It is an object of the present invention for 1 lb. flat bottom hemp paper bags to have widths ranging from two and a half inches to four and a half inches wide, gussets ranging from one and three quarter inches to three inches wide and lengths ranging from six inches to seven and a half inches long. It is an object of the present invention for 2 lb. flat bottom hemp paper bags to have widths ranging from three and a half inches to five and a half inches wide, gussets ranging from two inches to three and a half inches wide and lengths ranging from six inches to seven and a half inches long. It is an object of the present invention for 3 lb. flat bottom hemp paper bags to have widths ranging from four inches to six inches wide, gussets ranging from two inches to four inches wide and lengths ranging from eight inches to ten inches long.

It is an object of the present invention for 4 lb. flat bottom hemp paper bags to have widths ranging from four inches to six inches wide, gussets ranging from two and a half inches to four inches wide and lengths ranging from nine inches to eleven inches long. It is an object of the present invention for 5 lb. flat bottom hemp paper bags to have widths ranging from four inches to six inches wide, gussets ranging from three inches to five inches wide and lengths ranging from ten inches to twelve inches long. It is an object of the present invention for 6 lb. flat bottom hemp paper bags to have widths ranging from five inches to seven inches wide, gussets ranging from three inches to five inches wide and lengths ranging from ten inches to twelve inches long. It is an object of the present invention for 8 lb. flat bottom hemp paper bags to have widths ranging from five inches to seven inches wide, gussets ranging from three and a half inches to five inches wide and lengths ranging from eleven and a half inches to thirteen and a half inches long. It is an object of the present invention for 10 lb. flat bottom hemp paper bags to have widths ranging from five and a half inches to seven and a half inches wide, gussets ranging from three and three quarter inches to five and a quarter inches wide and lengths ranging from twelve and a half inches to fourteen and a half inches long. It is an object of the present invention for flat bottom hemp paper bags ranging in size between 0.5 lb and 10 lbs with or without handles to have basis weights ranging from twenty pounds to seventy pounds, preferably from twenty five pounds to sixty pounds.

It is an object of the present invention for 12 lb. flat bottom hemp paper bags to have widths ranging from six and a half inches to eight inches wide, gussets ranging from three and a half inches to five and a half inches wide and lengths ranging from twelve and three quarter inches to fourteen and three quarter inches long. It is an object of the present invention for 16 lb. flat bottom hemp paper bags to have widths ranging from seven inches to nine inches wide, gussets ranging from four inches to six inches wide and lengths ranging from fifteen inches to seventeen inches long.

It is an object of the present invention for 20 lb. flat bottom hemp paper bags to have widths ranging from seven inches to nine inches wide, gussets ranging from four and three quarter inches to seven inches wide and lengths ranging from twelve and a half inches to seventeen inches long. It is an object of the present invention for 25 lb. flat bottom hemp paper bags to have widths ranging from seven inches to nine inches wide, gussets ranging from four and a half inches to seven inches wide and lengths ranging from fourteen and three quarter inches to nineteen inches long. It is an object of the present invention for flat bottom hemp paper bags ranging in size between 12 lbs. and 25 lbs. with or without handles to have basis weights ranging from thirty pounds to seventy pounds, preferably from thirty five pounds to sixty pounds.

It is an object of the present invention for ⅙ sack flat bottom hemp paper bags with or without handles to have widths ranging from eleven inches to thirteen inches wide, gussets ranging from six inches to eight inches wide and lengths ranging from sixteen inches to eighteen inches long. It is an object of the present invention for 1/7 sack flat bottom hemp paper bags with or without handles to have widths ranging from eleven inches to thirteen inches wide, gussets ranging from six inches to eight inches wide and lengths ranging from thirteen inches to fifteen inches long. It is an object of the present invention for ⅛ sack flat bottom hemp paper bags with or without handles to have widths ranging from nine inches to eleven inches wide, gussets ranging from five inches to eight inches wide and lengths ranging from thirteen and three quarter inches to seventeen and a half inches long. It is an object of the present invention for flat bottom hemp paper bags with or without handles ranging in size between ⅙ sack and ⅛ sack to have basis weights ranging from thirty pounds to seventy pounds, preferably from thirty five pounds to sixty pounds.

It is an object of the present invention for the flat bottom hemp paper bags with or without handles to have basis weights ranging from twenty pounds to seventy pounds, preferably from twenty five pounds to sixty pounds.

It is an object of the present invention for the flat bottom hemp paper bags to have a window to see the contents of the bag. It is an object of the present invention for the flat bottom hemp paper bags to be used for merchandise, including groceries, gifts and toiletries. It is an object of the present invention for the flat bottom hemp paper bags, such as snack, window deli and chicken bags, to be used for food storage.

The present invention relates to flat bottom bags made of hemp paper. It is an object of the present invention for the flat bottom hemp paper bags to have a handle or handles. It is an object of the present invention for the flat bottom hemp paper bags with handles to have rounded, pouch shaped elliptical flat bottoms. It is an object of the present invention for the flat bottom hemp paper bags with handles to have rectangular or square shaped flat bottoms. It is an object of the present invention for the flat bottom hemp paper bags with handles to be used for food service and restaurant takeout and deliveries.

The present invention relates to hemp paper bags with handles. It is an object of the present invention for the hemp paper bag to have an opening below the handles so the hemp paper bag can be sealed. It is an object of the present invention for the handle to be a wave style handle. It is an object of the present invention for the handles to be detachable from the bag. It is an object of the present invention for the handle to be a twist handle, such as one made from plastic material or twine.

Twine is a strong thread, light string or cord composed of two or more thinner strands twisted, and then twisted or plied together. The strands are plied in the opposite direction to that of their twist, which adds torsional strength to the cord and keeps it from unravelling. It is an object of the present invention for the twine handles to be comprised of hemp paper, paper, rope or cloth material. It is an object of the present invention for the twine handles to consist of two or more strands of hemp paper, paper, cotton or nylon twisted together. It is an object of the present invention for the hemp paper bags to have twist handles made from hemp paper. It is an object of the present invention for the hemp paper bags to have twist handles made from paper. It is an object of the present invention for the hemp paper bags to have twist handles made from some combination of paper, nylon and hemp paper. It is an object of the present invention for the twist handles to be comprised of hemp paper handles enrobing an inner layer of nylon, cotton or twine.

It is an object of the present invention for the flat bottom hemp paper bags to have flat handles made from hemp paper. It is an object of the present invention for the flat bottom hemp paper bags to have flat handles made from paper or hemp paper. It is an object of the present invention to form a handle with a sheet of hemp paper with a fold line. The sheet of hemp paper is folded two times. The twice folded hemp paper is bent in one corner. The twice folded hemp paper with a bent corner, has a second bent corner so that the twice folded hemp paper forms a hemp paper handle.

It is an object of the present invention for the flat bottom hemp paper bags to have die cut handles. It is an object of the present invention for the pinch bottom hemp paper bags to have die cut handles comprised of hemp paper. It is an object of the present invention for the die cut handle to go through the front and back panels of the bag. It is an object of the present invention to close a hemp paper bag with die cut handles pushing the hanging panel of one side of the bag through the opening of the panel located on the opposite side of the bag.

The present invention relates to a flat bottom hemp paper bag that has handles, flat handles or twist handles attached to the outside or inside surface of the bag. It is an object of the present invention for those handles to comprise paper or twist handles that are attached to the bag by a single or double patch. It is an object of the present invention for the handles to be comprised of paper or hemp paper. Patches comprised of hemp paper affix the handles to the surface of the bag to make the handles stronger so that the handles will not easily rip from the bag. It is an object of the present invention for the flat bottom hemp paper bag to be made from hemp paper and the patch and handles to be made from paper or hemp paper.

It is an object of the present invention for the lower portion of the hemp paper handles attached to the outside or inside surface of the bag to be reinforced with a single or double paper patch made from hemp paper or paper. The hemp paper handles are either in the upward or downward position.

It is an object of the present invention for the flat bottom hemp paper bag to comprise a hemp paper handle and a single paper patch or single hemp paper patch on each outside surface of the bag. It is an object of the present invention for the flat bottom hemp paper bag to comprise a hemp paper handle and a double paper patch or double hemp paper patch on each outside surface of the bag. It is an object of the present invention to attach a hemp paper patch to each outside surface of the bag by using glue or paste. It is an object of the present invention for the glue or paste to be biodegradable and/or compostable.

It is an object of the present invention for the paper patch or hemp paper patch to be a single patch attached over the lower portion of the first and second hemp paper handles. It is an object of the present invention for the first and second hemp paper handles to be in an upward or downward position.

The present invention relates to a flat bottom hemp paper bag with handles comprising an outside surface and an inside surface and two twist handles comprised of twine or paper. A lower portion of each of the twist handles is attached to the outside or inside surface of the bag on opposite sides of the bag. Each of the twist handles is reinforced with a hemp paper patch attached to the outside or inside surface of the bag covering the lower portion of each of the twist handles.

It is an object of the present invention for the twist handles to be in an upward or downward position. It is an object of the present invention for the hemp paper patch to prevent the twist handles from ripping or detaching from the bag.

The present invention relates to a flat bottom hemp paper bag with handles comprising: an outside surface and an inside surface. A first hemp paper patch is attached to the outside surface of the bag, and a second hemp paper patch is attached to the outside surface on the opposite side of the bag. A lower portion of a first hemp paper handle is attached to the first hemp paper patch and a lower portion of a second hemp paper handle is attached to the second paper patch. A third hemp paper patch is glued above the lower portion of the first hemp paper handle to sandwich the lower portion of the first hemp paper handle between the first patch and third patch. A fourth hemp paper patch is glued above the lower portion of the second handle to sandwich the lower portion of the second handle between the second patch and fourth patch. It is an object of the present invention for the handles to be in the upward position. It is an object of the present invention for the handles to be in the downward position.

It is an object of the present invention for the flat bottom hemp paper bags with hemp paper handles and hemp paper patches attached to the outside of the bag for each individual bag itself to be between eight inches and fifteen inches in width, eight inches and fifteen inches in length and have a gusset between three inches and eight inches.

It is an object of the present invention for the flat bottom hemp paper bags that have hemp paper flat handles to be comprised of a strip of hemp paper folded to form a folded hemp paper handle that extends between one inch and five inches in length from the top of the bag, such handles to be between three inches and five inches in width. It is an object of the present invention for the folded hemp paper flat handle to extend between two inches and five inches below the top edge of the bag.

It is an object of the present invention for the hemp paper patch described above to be between five inches and ten inches in width and between two inches and five inches in length.

It is an object of the present invention for the hemp paper handles to comprise hemp paper with a basis weight between ten pounds and one hundred pounds, preferably ten pounds to seventy pounds. It is an object of the present invention for the flat bottom hemp paper bags with hemp paper handles to be bleached or unbleached in color. It is an object of the present invention for the flat bottom hemp paper bags with hemp paper handles described above to be comprised of color. It is an object of the present invention for the hemp paper handles described above to be bleached or unbleached in color. It is an object of the present invention for the hemp paper handles described above to be comprised of color.

The present invention relates to a flat bottom hemp paper bag with handles or retail shopping bag with handles comprising a heavy duty polyethylene insert, paper cardboard insert, or cardboard insert comprised of hemp paper placed at the bottom of the bag. It is an object of the present invention for the insert to add extra strength to the hemp paper bag and provide the hemp paper bag with a non-sagging appearance. It is an object of the present invention for the retail shopping bag made of hemp paper to be of single-walled construction.

The present invention relates to a shopping bag for retail purposes made of hemp paper. It is an object of the present invention for the hemp paper shopping bag to have handles made of cloth, rope or twine. The present invention relates to a hemp paper shopping bag for retail purposes made of flipside paper, namely a bag made with bleached paper on the outside and unbleached paper on the inside. The present invention relates to a hemp paper shopping bag for retail purposes made of flipside paper, namely a bag made with bleached paper on the inside and unbleached paper on the outside. It is an object of the present invention for the retail shopping bag made of hemp paper to be a flipside hemp paper bag. It is an object of the present invention for the retail shopping bag made of hemp paper to be of double-walled construction.

The present invention relates to a flat bottom hemp paper bag having a closure mechanism internal to the bag. The present invention relates to a closed flat bottom hemp paper bag with a folded over portion attached to an adhesive strip. It is an object of the present invention for a flat bottom hemp paper bag to have a peel-off adhesive strip or label to close the flat bottom hemp paper bag, attaching to a top of the bag that is folded over.

The present invention relates to a flat bottom hemp paper bag with two adhesive strips. The bag is closed by folding over the flat bottom hemp paper bag so that the folded over bag is attached to the body of the hemp paper bag with an adhesive from one of the adhesive strips. The hemp paper bag is folded a second time to attach to the second adhesive strip to be resealed or closed.

The present invention relates to a flat bottom hemp paper bag with an opening. The bag has an adhesive closure mechanism internal to the bag. The present invention relates to a flat bottom hemp paper bag with an opening, and two adhesive strips, wherein the bag is closed by folding over the top of the bag at least one time and attaching it to one of the adhesive strips located on the body of the bag. It is an object of the present invention for the top of the bag to be folded over more than once and resealed or closed with a second adhesive strip located on the body of the bag.

It is an object of the present invention for a flat bottom hemp paper bag or pinch bottom hemp paper bag to have an indicator or instructions for showing a user where to close the bag after a product is placed in the bag. It is an object for the flat bottom hemp paper bag or pinch bottom hemp paper bag to be opaque.

It is an object of the present invention that the hemp paper be oil and grease resistant, preventing grease from escaping through the bag. It is an object of the present invention for a flat bottom hemp paper bag or pinch bottom hemp paper bag to be oil and grease resistant. It is an object of the present invention for the hemp paper bag to be coated with an oil and grease resistant material.

It is an object of the present invention for the hemp paper bag to be leak-proof. It is an object of the present invention that the hemp paper bag be coated with a water-resistant material. It is an object of the present invention for the hemp paper bag to be moisture proof, preventing liquids or condensation from escaping the bag. It is an object of the present invention for the hemp paper bag to be microwave safe.

It is an object of the present invention for the hemp paper bag to be recyclable. It is an object of the present invention for the hemp paper bag to be curbside recyclable.

The present invention relates to a hemp paper bag comprised of hemp paper that is more environmentally friendly than a bag made of plastic or polyethylene. It is an object of the present invention for the hemp paper bag to be toxin free. It is an object of the present invention for the hemp paper bag to be chlorine free. It is an object of the present invention for the hemp paper bag not to include BPAs (bisphenol A), Lead, Phthalates, and PFAs (perfluoroalkoxy alkanes). It is an object of the present invention for the hemp paper bag to be biodegradable. It is an object of the present invention for the hemp paper bag to be compostable. It is an object of the present invention for the hemp paper bag to have some combination of the following environmentally friendly features: chlorine free, toxin free, compostable, recyclable, biodegradable, BPA free, lead free, Phthalates free, PFA free. It is an object of the present invention for the hemp paper bag to comprise a PLA (poly lactic acid) coating. It is an object of the present invention for the PLA coated hemp paper bag to be edible by humans and/or microorganisms. It is an object of the present invention for the hemp paper bag to be assembled by glue, paste or some combination thereof, each certified as food safe.

It is an object of the present invention for a flat bottom hemp paper bag or pinch bottom hemp paper bag to be treated with wax to provide better storage and handling for the object or objects placed inside the bag. It is an object of the present invention for a flat bottom hemp paper bag or pinch bottom hemp paper bag to be double waxed. Double waxed is defined as adding a further layer of wax.

In an embodiment, the hemp paper bag has a lifting flap which when opened provides an opening which allows objects to be placed in the bag. The flap can then be closed.

It is an object of the present invention for the flap to comprise hemp. In a preferred embodiment the flap is securely attached to the bag once the objects are placed inside. In an embodiment the flap is placed on the hemp paper bag below a sealing mechanism which separates the bag opening from the handles on the bag.

In an embodiment of the present invention, the hemp paper bags have a wide face and a seamless construction, which provides an excellent surface area to accept all types of graphics on the front, back and side gussets of the bag. In an embodiment there are no vertical seams to restrict print areas.

It is an object of the present invention for the hemp paper bags comprised of hemp paper to be printable, allowing for ink and graphics to be attached to the paper. It is an object of the present invention for the hemp paper bags to be printable with water-soluble inks. It is an object of the present invention for the hemp paper bags to be printable with non-water-soluble inks. It is an object of the present invention for the hemp paper bags to be printable with inks certified as food safe. It is an object of the present invention for the hemp paper bag to comprise flexographic printed graphics or text, digitally printed graphics or text, post-printed graphics or text, or pre-printed graphics or text. It is an object of the present invention for the hemp paper bag to have coupons, bar codes, or QR codes printed on the bag. It is an object of the present invention to use printed information on the hemp paper bag such as bar codes to track sales of the hemp paper bag or sales of items in the hemp paper bag.

It is an object of the present invention for a flat bottom hemp paper bag or pinch bottom hemp paper bag to contain printed social messaging. It is an object of the present invention to use printed information on the hemp paper bag such as bar codes to track the impact of social messaging on sales of the hemp paper bag or sales of items in the hemp paper bag.

The present invention relates to providing a surface area to accept graphics on both the front and back of the hemp paper bag. It is an object of the present invention for the hemp paper bag to accept all types of graphics on at least one side gusset of the bag. It is an object of the present invention for the hemp paper bag to have an advertisement printed on it. It is an object of the present invention for the hemp paper bag to have at least one advertisement printed on or attached to the front of the bag, such as a peel-off coupon, and at least one advertisement printed on or attached to the back of the bag. It is an object of the present invention for the hemp paper bag to have at least one advertisement printed on at least one side gusset of the bag. It is an object of the present invention that the hemp paper bag be used as an advertising vehicle to communicate messages, coupons or contests to customers.

The present invention relates to methods for printing from a digital-based image directly onto products made from hemp paper. Digital printing refers to methods of printing from a digital-based image onto a surface or substrate, without requiring the need for separate, analog plates. Unlike conventional ink used in offset printing, the ink or toner used in digital printing does not permeate the substrate but forms a thin layer on the surface.

The present invention relates to a method of digital printing of graphics and/or text on pinch bottom hemp paper bags and flat bottom hemp paper bags. It is an object of the present invention for the digital printing system to print repeated images of the graphics and/or text on the hemp paper.

The present invention relates to a method that comprises using a separate digital printing system to pre-print single or multiple color graphics and/or text on rolls of hemp paper used to make hemp paper bags. It is an object of the present invention for the method to comprise using a separate digital printing system to pre-print on rolls of hemp paper prior to the hemp paper being fed to a bag machine for producing pinch bottom hemp paper bags or flat bottom hemp paper bags. It is an object of the present invention for the ink or toner to form a thin layer on the surface of the hemp paper. It is an object of the present invention for the ink or toner to be adhered to the hemp paper by using some combination of fuser fluid, heat or UV curing. It is an object of the present invention for the digital printing system to print continuously on the hemp paper as it is unrolled and fed to a bag machine.

The present invention relates to a method that comprises using a digital printing system to post-print single or multiple color graphics and/or text on hemp paper bags. It is an object of the present invention for the method to comprise taking hemp paper bags already separately produced on a bag machine and feeding the hemp paper bags to a separate digital printing system.

It is an object of the present invention for the method to comprise the digital printing system depositing ink or toner onto the hemp paper bag surface to form an image. It is an object of the present invention for the ink or toner to form a thin layer on the surface of the hemp paper bag. It is an object of the present invention for the ink or toner to be adhered to the hemp paper bags by using some combination of fuser fluid, heat, or UV curing.

It is an object of the present invention to have a digital printing system to use inkjet printing featuring Piezo print heads to achieve photo quality printing onto pinch bottom hemp paper bags or flat bottom hemp paper bags. It is an object of the present invention to have a digital printing system to use inkjet printing featuring Piezo print heads to achieve photo quality printing onto flat bottom hemp paper bags that have handles.

In an embodiment, the hemp paper bags of the present invention have a wide opening at the top to make it easier to insert products. It is an object of the present invention for the hemp paper bags to have a means for separating the bags from a dispenser.

It is an object of the present invention for the hemp paper bag to be attached at the top edge to a header which keeps a gang of fifty to one hundred bags together for use with a dispenser. It is an object of the present invention for the header to be made of hemp paper. It is an object of the present invention for a header such as a padded header to hold the gang of hemp paper bags together. The hemp paper bag has a slit which is used to hang the bag on a dispenser. It is an object of the present invention for the hemp paper bag to have tear-off perforations so that the bag can be removed from a dispenser. The space between line and perforations reflects a lip that appears after the hemp paper bag is torn off and provides easy access for opening the bag even while the bag is on the dispenser.

It is an object of the present invention for the hemp paper bag to have a slit above the tear-off perforations so that the bag can be hung on hooks. It is an object of the present invention for the hemp paper bag to be dispensable from a plurality of hooks. It is an object of the present invention for the hemp paper bag to be dispensable in multiple quantities. It is an object of the present invention for the hemp paper bag to have a width of five inches to seven inches and a height of eleven inches to thirteen inches. It is an object of the present invention for the bottom gusset to be two inches to ten inches so that the hemp paper bag can open flat on the bottom when expanded.

It is an object of the present invention for the hemp paper bag with tear-off perforations to have a height of twelve inches and a width of seven inches. It is an object of the present invention for the area above the tear-off perforations to be one inch. It is an object of the present invention for the area for the bottom gusset to be one and one quarter inches.

It is an object of the present invention to have a stand-alone dispensable hemp paper bag having its top open after it is torn off at the perforations, where a stand-alone dispensable bag is defined as a bag that can stand by itself when opened. The rear panel is extended above the front panel after the bag has been torn off and opened. It is an object of the present invention for the bottom gusset to open to between two and one half inches and ten inches. A flat bottom allows the separated hemp paper bag once expanded to stand on its own without additional support.

The hemp paper bag has a tear off perforation for separating the bag from the header. The hemp paper bag has a seal which separates the handle from the bottom of the bag. A front flap is located below the seal. Once the front flap is lifted up an opening allows a user to place objects inside of the bag. The hemp paper bag further has a bottom gusset. It is an object of the present invention for the hemp paper bag with die cut handles to have a see-through window.

It is an object of the present invention for the hemp paper bag to have a flap which covers an opening in the front or back of the bag. The bag can be filled by lifting the flap and placing the objects into the front or back pocket beneath the flap. The flap is then closed. It is an object of the invention to staple the flap securely to keep objects from falling out of the bag. It is an object of the present invention to provide a sealing means to seal the flap to the bag. It is an object of the present invention to provide a snap or other closing device to close the flap to the bag. It is an object of the present invention to provide handles which are sealed separately above the flap. It is an object of the present invention for the handles to not affect the opening of the bag. It is an object of the present invention to provide a die cut handle above a seal which separates the flap and bottom of the bag from the handle.

The present invention relates to a bag comprised of hemp paper that can be closed, sealed, or resealed for holding food or other objects and products. A hemp paper bag that is closed does need not be air-tight or fully closed, as long as it is closed enough to not allow a product to fall out of the bag. A hemp paper bag that is sealed or resealed can be sealed or resealed so that no liquid or air can penetrate the seal. A hemp paper bag that is sealed or resealed can be sealed or resealed enough such as 95%, that the bag is almost completely air-tight or liquid tight.

The present invention relates to a hemp paper bag for holding or storing food items or other objects comprising a pinch bottom hemp paper bag or flat bottom hemp paper bag, the bag having an opening, and at least one fold over portion at the top of the hemp paper bag, and a closure mechanism. It is an object of the present invention for the top portion of the hemp paper bag to be attached to the body of the hemp paper bag by the closure mechanism. It is an object of the present invention for the hemp paper bag to have a window that allows a user to see the contents of the bag.

It is an object of the present invention for the closure mechanism to comprise a strip of adhesive across the side, top, or bottom of the hemp paper bag for sealing the bag closed.

It is an object of the present invention for the closure mechanism to comprise a peel-off sticker or label attached to the hemp paper bag to seal or reseal the bag, the peel-off sticker or label is defined as a device having a hemp paper strip or piece that covers adhesive, and when the hemp paper strip or piece is removed, adhesive is functional. It is an object of the present invention for the hemp paper strip or piece consisting of hemp paper to be recyclable, compostable, biodegradable or any combination. It is an object of the present invention for the peel-off strip to be a coupon.

It is an object of the present invention for the hemp paper bag to comprise a strip of adhesive across some combination of the side of the bag, top of the bag or bottom of the bag to seal the bag closed. It is an object of the present invention for the strip of adhesive to be partially across some combination of the side of the hemp paper bag, top of the hemp paper bag or bottom of the hemp paper bag to close the bag, but not seal the bag closed. It is an object of the present invention for the adhesive to seal some combination of the side, top and/or bottom of the hemp paper bag.

It is an object of the present invention to use a peel-off label or strip that is unattached to the hemp paper bag to seal or reseal the bag. It is an object of the present invention for the peel-off label or strip that seals the hemp paper bag to have adhesive on both sides of the label or strip. It is an object of the present invention for the peel-off label or strip that seals the hemp paper bag to have adhesive on one side of the label or strip. It is an object of the present invention for the peel-off label or strip to have a paper, i.e., hemp paper, affixed to the adhesive that can be peeled off. It is an object of the present invention to attach the peel-off label or strip to one side of the top of the hemp paper bag after removing the peel-off strip or label. It is an object of the present invention for the user of the sealable or resealable hemp paper bag to remove the remaining peel-off strip or label and press the side with the adhesive against the side without the adhesive to seal the bag.

It is an object of the present invention for the peel-off strip or label to comprise hemp paper. It is an object of the present invention for the peel-off strip or label to consist of hemp paper.

It is an object of the present invention for a hemp paper bag to have an opening, and two peel off adhesive strips located above each other. To initially close the hemp paper bag, the top of the hemp paper bag is folded over and a strip of paper made from hemp is removed from the adhesive strip and the top of the bag is attached to the first adhesive. The hemp paper bag can then be opened and any items removed. The hemp paper bag can then be reclosed by folding the top of the bag again and removing the second strip of hemp paper from the adhesive strip and attaching the folded over top of the bag to the second adhesive.

It is an object of the present invention for the hemp paper bag to comprise an interlocking slot closure mechanism. It is an object of the present invention for the closure mechanism to be located at the top, bottom or side of the hemp paper bag. It is an object of the present invention for the hemp paper bag to comprise an interlocking slot closure mechanism and an adhesive closure.

It is an object of the present invention for the pinch bottom hemp paper bag or flat bottom hemp paper bag to be tamper proof. It is an object of the present invention for the bag to comprise a tamper proof seal on top of the flat bottom hemp paper bag. It is an object of the present invention for the pinch bottom hemp paper bag or flat bottom hemp paper bag to have a double seal, making the bag tamper proof.

The present invention relates to a tamper proof flat bottom hemp paper bag with an opening at the bottom of the bag. It is an object of the present invention for a food item to be loaded from the bottom of the flat bottom hemp paper bag. It is an object of the present invention for the flat bottom hemp paper bag to have an adhesive closure mechanism on the bottom of the bag. It is an object of the present invention for the bag to comprise handles on the top of the flat bottom hemp paper bag.

The present invention relates to pouches, defined as a bag of small or moderate size for storing or transporting goods, made from hemp paper. It is an object of the present invention for the pouches to have a zip seal. It is an object of the present invention for the pouches made from hemp paper to be between two inches and twelve inches wide with a length ranging from four inches to fifteen inches long. It is an object of the present invention for the pouches made from hemp paper to have basis weights ranging from ten pounds to seventy pounds.

The present invention relates to precut newsprint sheets, also commonly known as wrapping paper or packing paper, comprised of hemp paper. The present invention relates to precut newsprint sheets made from one hundred percent hemp.

It is an object of the present invention for newsprint sheet hemp paper to be made from some combination of hemp hurd, hemp bast fiber, post-consumer recycled content wood pulp, post-industrial recycled content wood pulp, preservatives, chemicals and additives.

The present invention relates to providing different sizes of precut hemp paper newsprint sheets in a package. It is an object of the present invention for two stacks of different size precut hemp paper newsprint sheets to have a larger size precut hemp paper newsprint sheets placed on top of a smaller size precut hemp paper newsprint sheets and the precut hemp paper newsprint sheets rolled together. It is an object of the present invention to place a colored piece of paper in between the two sizes in a cylindrical shape. It is an object of the present invention to have to the groups of precut hemp paper newsprint sheets shrink wrapped together. It is an object of the present invention to have a label affixed to the shrink wrap.

BRIEF DESCRIPTION OF DRAWINGS

FIG. 10*a* shows the lower portion of a hemp paper flat handle attached to a hemp paper patch, wherein the hemp paper flat handle is in the upward position.

FIG. 10*b* shows the lower portion of a hemp paper flat handle attached to a hemp paper patch, and a second hemp paper patch attached to the first hemp paper patch, wherein the lower portion of the hemp paper flat handles is sandwiched between the first and second hemp paper patch. The hemp paper flat handle is in the upward position.

FIG. 10*c* shows the hemp paper patch and the hemp paper flat handle of FIG. 10*b* wherein the hemp paper flat handle is in the downward position.

FIG. 10*d* shows the hemp paper patch and hemp paper flat handle of FIG. 10*c* showing an internal view of the hemp paper patch, that shows the lower portion of the hemp paper flat handle sandwiched between the two hemp paper patches and the hemp paper flat handle in the downward position.

FIG. 10*e* shows a flat bottom hemp paper bag laid down on one side, showing an internal view of the bag with the hemp paper patch and hemp paper flat handle of FIG. 10*d* attached to the bottom inside surface of the bag. The upper portion of the hemp paper flat handles are in the downward position.

FIG. 10*f* shows a flat bottom hemp paper bag laid down on one side, showing an internal view of the bag with the hemp paper patch and hemp paper flat handle of FIG. 10*d* attached on both the top and bottom inside surface of the bag. The upper portion of the hemp paper flat handles are in the downward position.

FIG. 10*g* shows a flat bottom hemp paper bag laid down on one side, with the bag wide open, showing the lower portion of a hemp paper flat handle sandwiched between two hemp paper patches that are attached to the bottom inside surface of the bag. The upper portion of the hemp paper flat handle is in the downward position.

FIG. 10*h* shows a flat bottom hemp paper bag in an upright position showing an inside hemp paper patch attached to the inside surface of the bag with the lower portion of the hemp paper flat handle underneath the hemp paper patch. The hemp paper flat handle is in the downward position.

DETAILED DESCRIPTION OF THE DRAWINGS

Figure 1B:
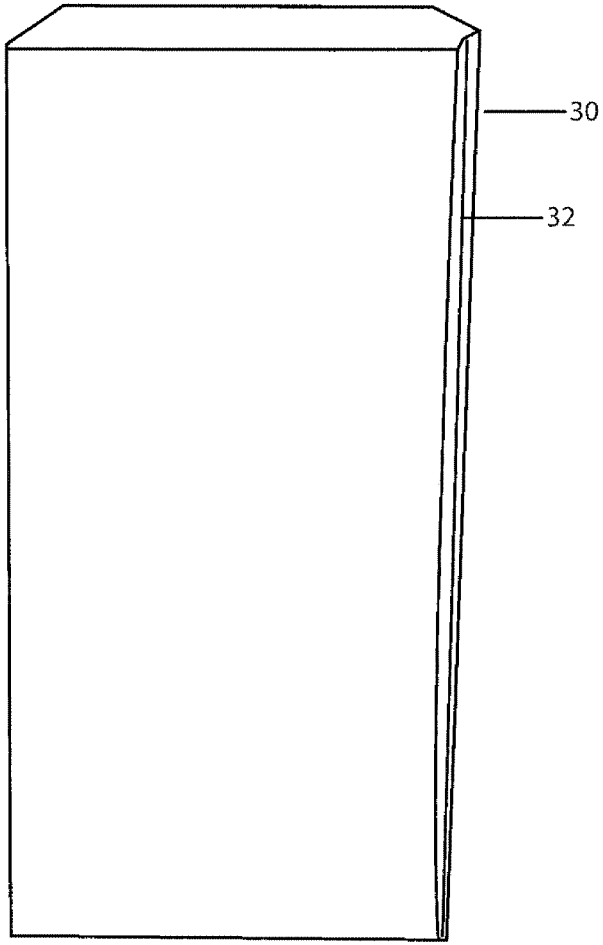
FIG. 1*b* shows a front view of a pinch bottom hemp paper bag of FIG. 1*a*.
Figure 1A:
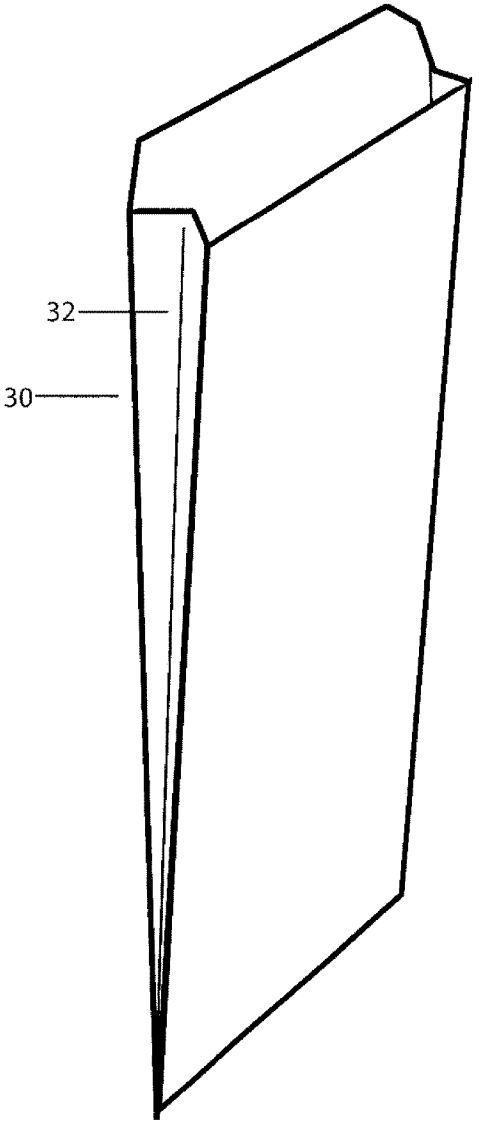
FIG. 1*a* shows a front side view of a pinch bottom hemp paper bag with a gusset.

FIG. 1*a* shows a front side view of a pinch bottom hemp paper bag 30 with a gusset 32. FIG. 1*b* shows a front view of a pinch bottom hemp paper bag 30 of FIG. 1*a* that has a gusset 32.

Figure 2B:
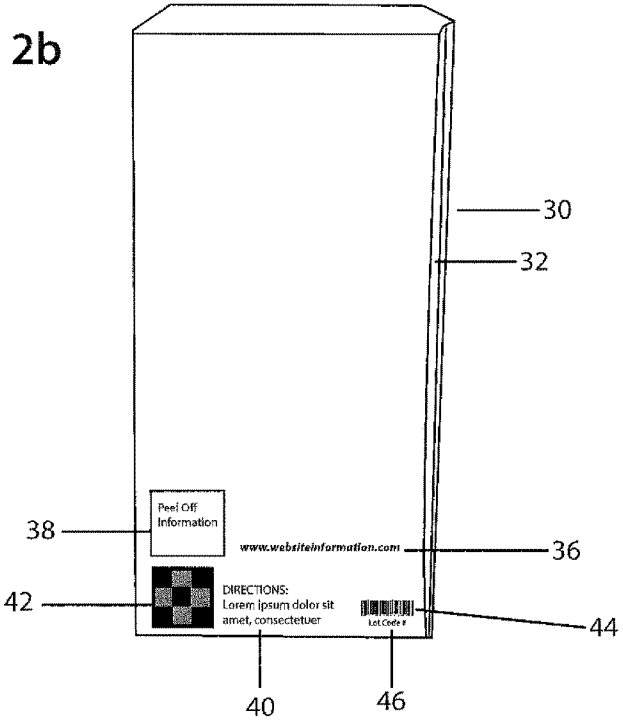
FIG. 2*b* shows a front view of a pinch bottom hemp paper bag of FIG. 2*a*.
Figure 2A:
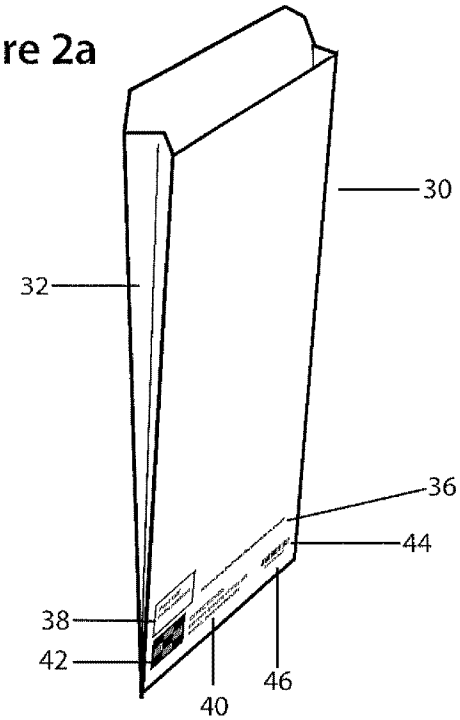
FIG. 2*a* shows a front side view of a pinch bottom hemp paper bag showing text, information and ways for tracking the bag or sales of items in the bag.

FIG. 2*a* shows a front side view of a pinch bottom hemp paper bag 30 with side gussets 32 having a website address 36, peel off information sticker 38, messaging 40, QR code 42, bar code 44 and lot code 46.

FIG. 2*b* shows a front view of a pinch bottom hemp paper bag 30 with side gussets 32 having a website address 36, peel off information sticker 38, messaging 40, QR code 42, bar code 44 and lot code 46.

Figure 2C:
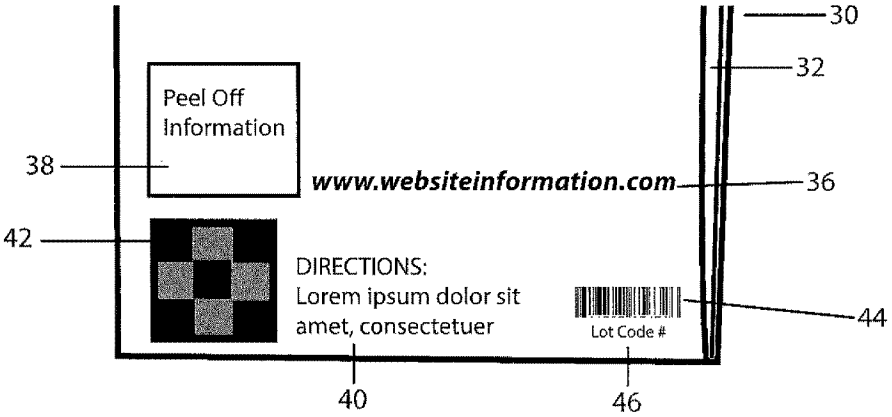
FIG. 2*c* shows a closeup front view of the bottom of a pinch bottom hemp paper bag of FIG. 2*a* showing text, information and ways for tracking the bag or sales of items in the bag.

FIG. 2*c* shows a closeup front view of the bottom of a pinch bottom hemp paper bag 30 with side gussets 32 having a website address 36, peel off information sticker 38, messaging 40, QR code 42, bar code 44 and lot code 46.

Figure 3A:
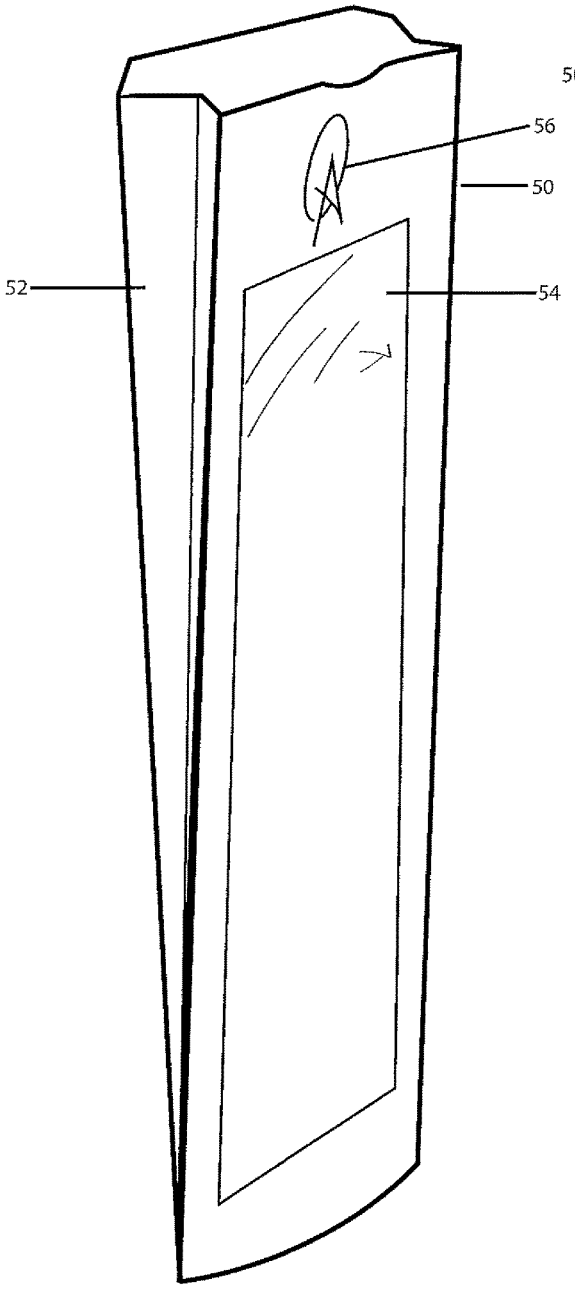
FIG. 3*a* shows a front side view of a pinch bottom hemp paper bag with side gussets and a window, the bag showing printed graphics or design.

FIG. 3*a* shows a side view of a pinch bottom hemp paper bag 50 with side gussets 52 and a window 54, the bag showing printed graphics or design 56.

Figure 3B:
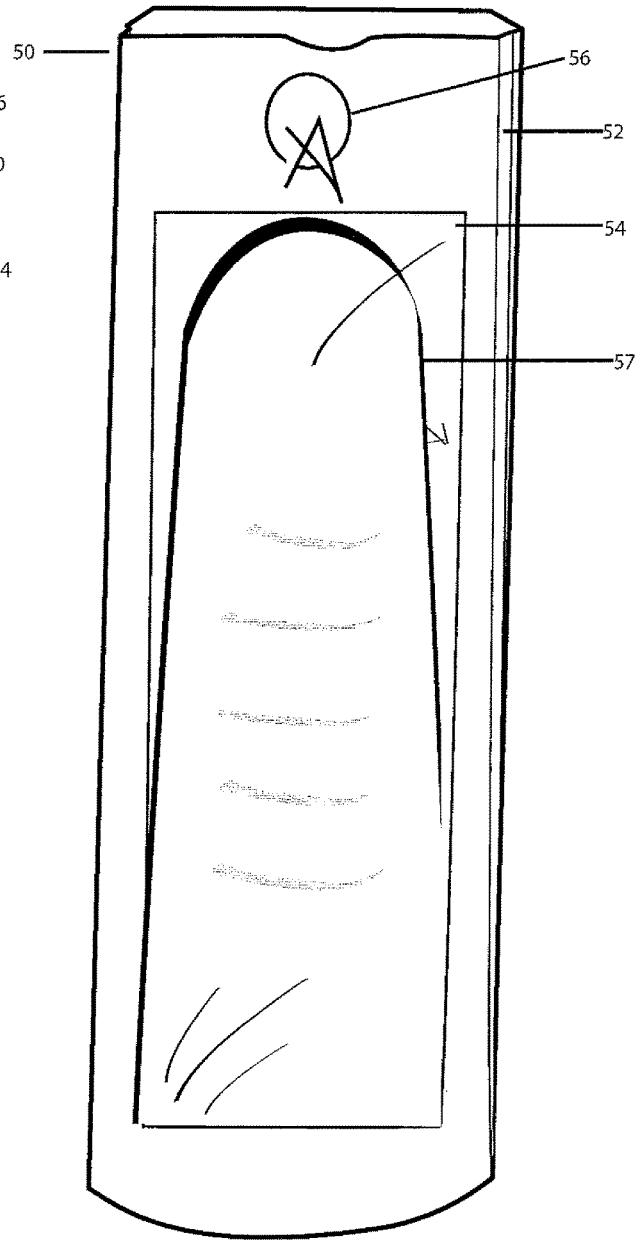
FIG. 3*b* is a front view of a pinch bottom hemp paper bag of FIG. 3*a*, the bag having a window showing an object in the bag.

FIG. 3*b* is a front view of a pinch bottom hemp paper bag 50 with side gussets 52, the bag having a window 54 showing an object or food item 57 in the bag. The bag shows printed graphics or design 56.

Figure 4B:
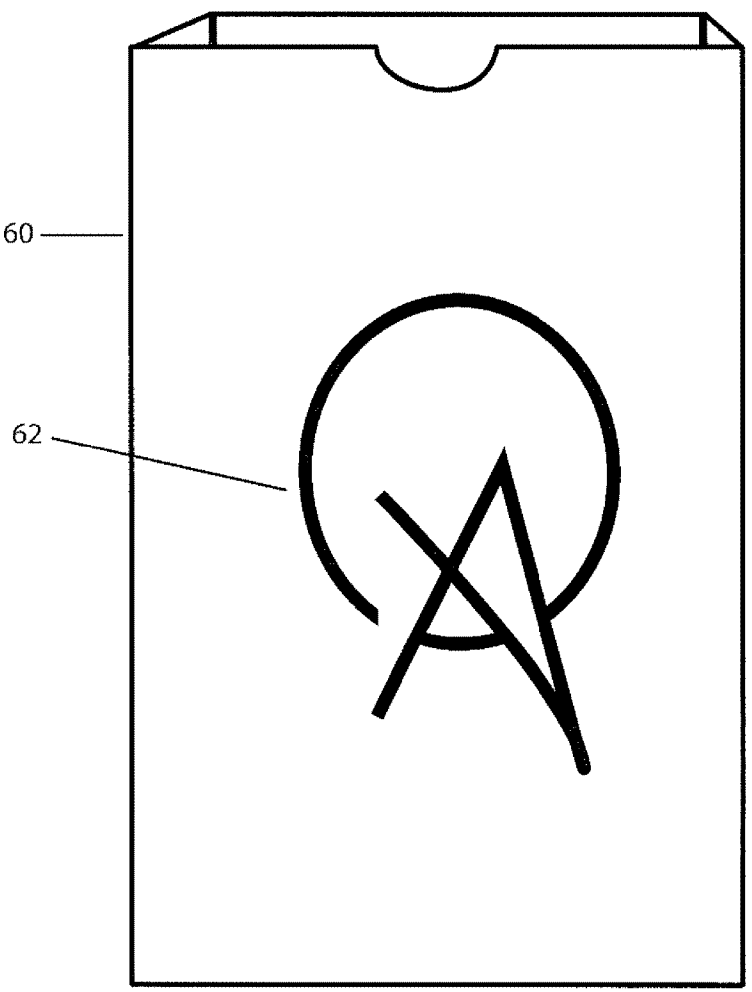
FIG. 4*b* shows a front view of a flat bottom hemp paper bag of FIG. 4*a*.
Figure 4A:
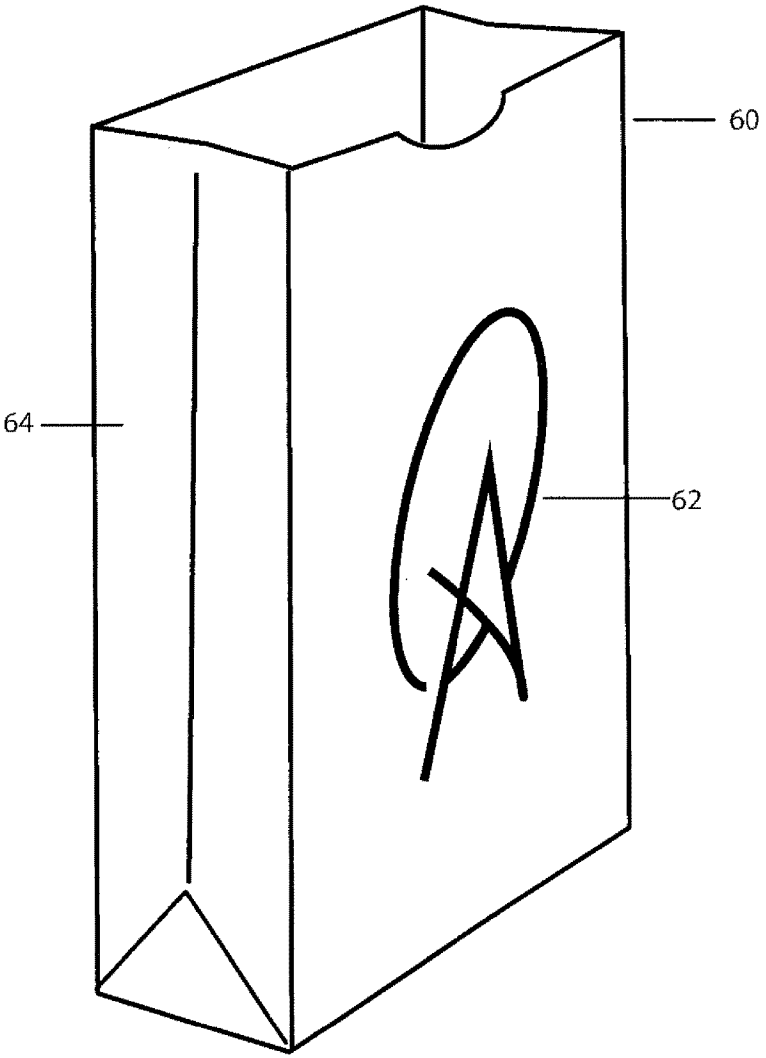
FIG. 4*a* shows a front side view of a flat bottom hemp paper bag, the bag showing printed graphics or design.

FIG. 4*a* shows a front side view of a flat bottom hemp paper bag 60 with side gussets 64, the bag showing printed graphics or design 62.

FIG. 4*b* shows a front view of a flat bottom hemp paper bag 60 with printed graphics or design 62.

Figure 5B:
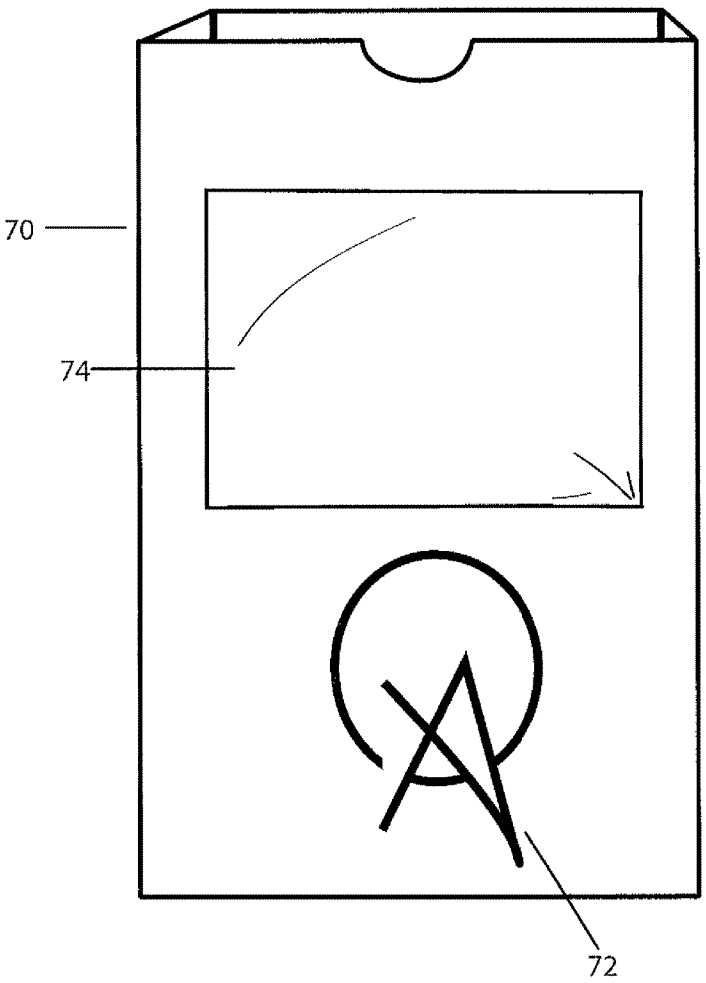
FIG. 5*b* shows a front view of a flat bottom hemp paper bag of FIG. 5*a*.
Figure 5A:
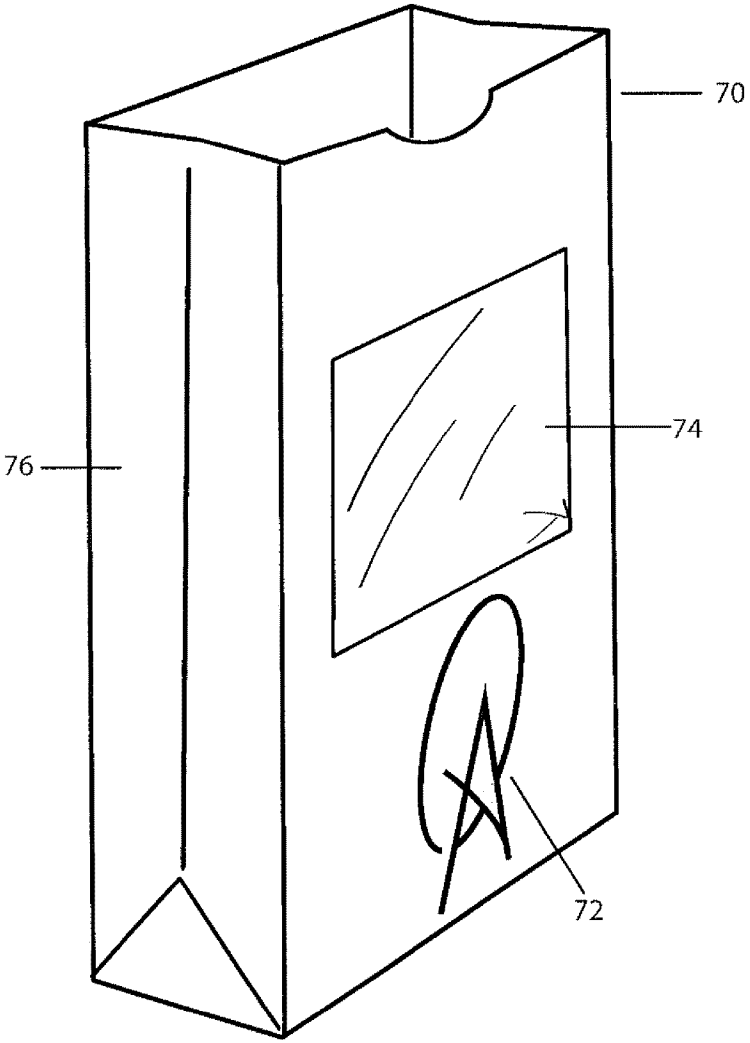
FIG. 5*a* shows a front side view of a flat bottom hemp paper bag with side gussets and a window, the bag showing printed graphics or design.

FIG. 5*a* shows a front side view of a flat bottom hemp paper bag 70 with side gussets 76 and a window 74, the bag showing printed graphics or design 72.

FIG. 5*b* shows a front view of a flat bottom hemp paper bag 70 with printed graphics or design 72 and a window 74.

Figure 6A:
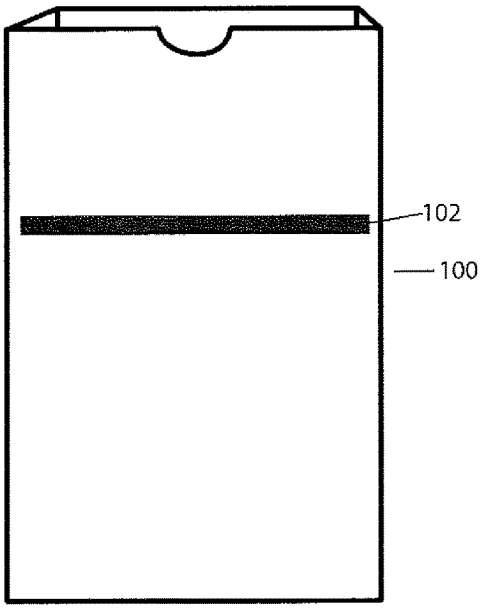
FIG. 6*a* shows a front view of an open flat bottom hemp paper bag with an adhesive strip.

FIG. 6*a* shows a front view of an open flat bottom hemp paper bag 100 with an adhesive strip 102.

Figure 6B:
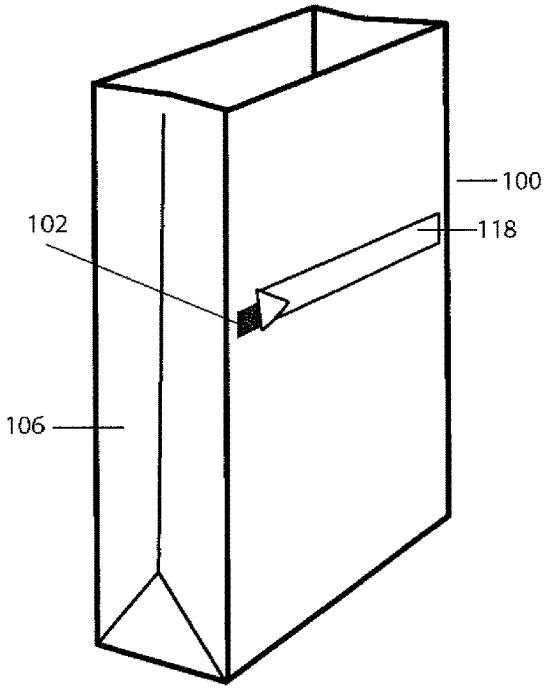
FIG. 6*b* shows a front side view of an open flat bottom hemp paper bag with a peel off hemp paper adhesive strip.

FIG. 6*b* shows a front side view of an open flat bottom hemp paper bag 100 with side gussets 106 and a partially peeled off hemp paper strip 118 on an adhesive 102.

Figure 6C:
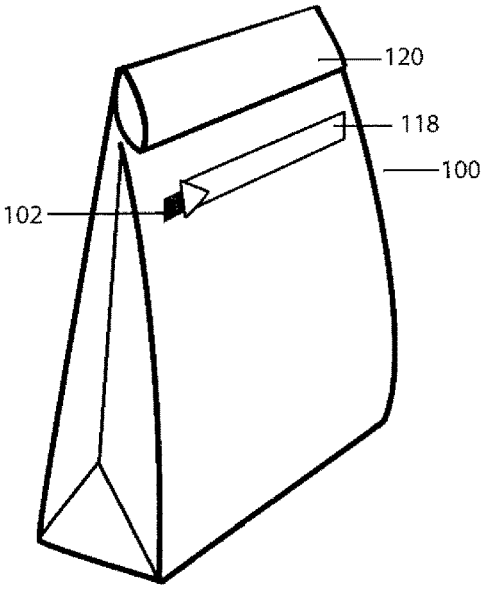
FIG. 6*c* shows a front side view of a closed flat bottom hemp paper bag with a peel off hemp paper adhesive strip.

FIG. 6*c* shows a front side view of a closed flat bottom hemp paper bag 100 with a partially peeled off hemp paper strip 118 on an adhesive 102, and the top 120 of the bag 100 rolled over.

Figure 6D:
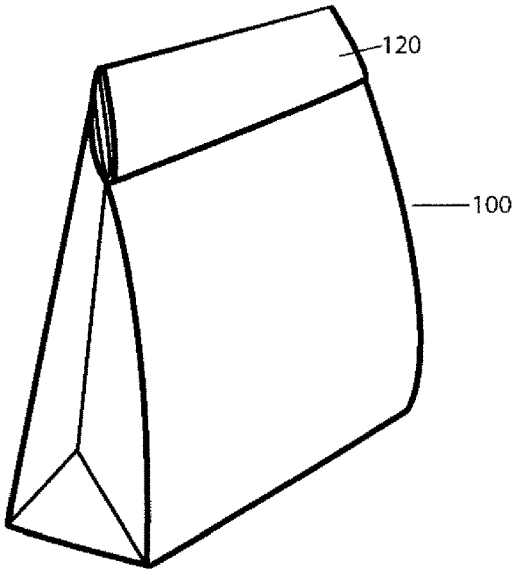
FIG. 6*d* shows a front side view of a closed sealed flat bottom hemp paper bag.

FIG. 6*d* shows a front side view of a closed flat bottom hemp paper bag 100 with a top 120 of the bag 100 rolled over and attached to an adhesive strip 102 (not shown).

Figure 7C:
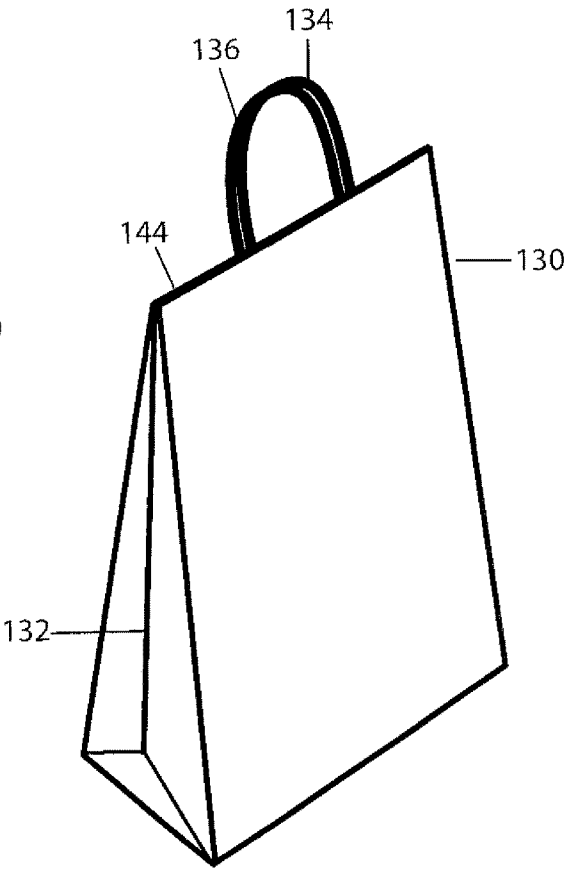
FIG. 7*c* shows a front side view of a flat bottom hemp paper bag in an upright position showing the bag with side gussets and hemp paper twist handles, the bag having an inside patch (not shown) with a peel off adhesive strip fully removed to seal the bag in a closed position.
Figure 7B:
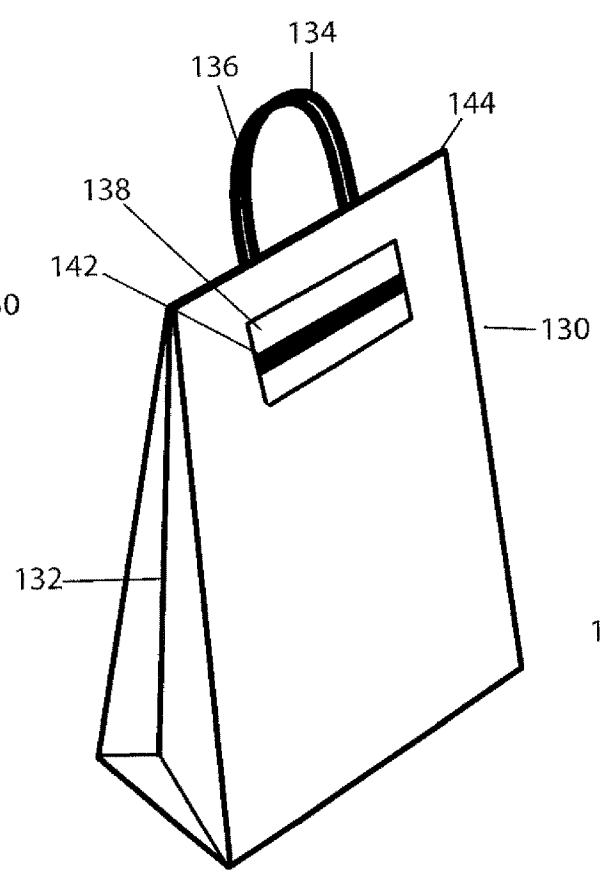
FIG. 7*b* shows an internal view of a flat bottom hemp paper bag in an upright position showing the bag with side gussets and hemp paper twist handles, the bag having an inside patch with a peel off hemp paper or paper adhesive strip fully removed and the bag in a closed position.
Figure 7A:
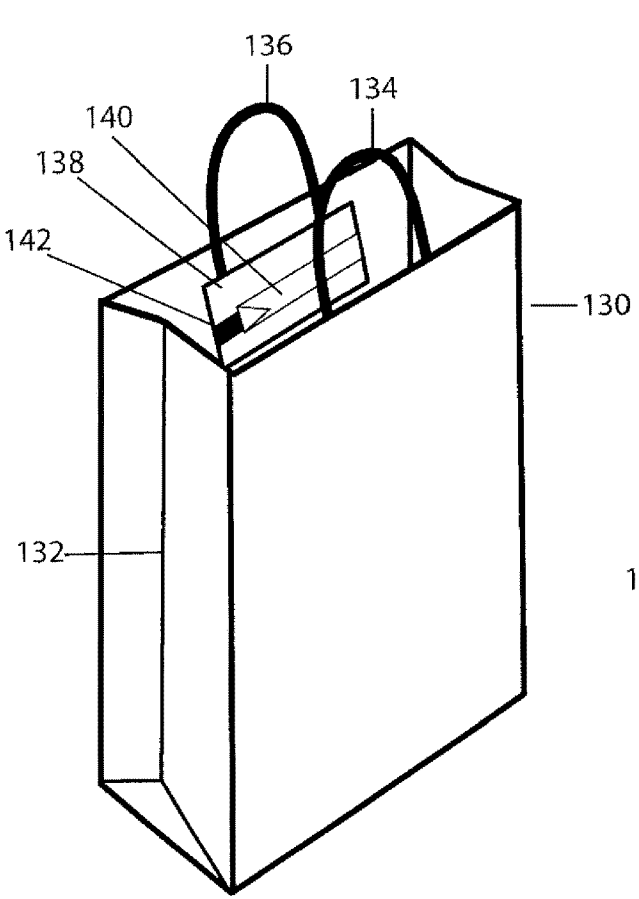
FIG. 7*a* shows a front side view of a flat bottom hemp paper bag in an upright position showing the bag with side gussets and hemp paper twist handles, the bag having an inside patch with a peel-off adhesive strip partially removed and the bag in an open position.

FIG. 7*a* shows a front side view of a flat bottom hemp paper bag 130 in an upright position showing the bag with side gussets 132 and hemp paper twist handles 134 and 136, the lower portion of hemp paper twist handle 136 underneath an inside patch 138 that has a partially peeled off hemp paper strip 140 on an adhesive 142 and the bag in an open position.

FIG. 7*b* shows an internal front side view of a flat bottom hemp paper bag 130 in an upright position showing the bag with side gussets 132 and hemp paper twist handles 134 and 136. An internal view of the inside hemp paper patch 138 shows the adhesive 142 adhering to the inside of the hemp paper bag with handles, the bag in a closed position 144.

FIG. 7*c* shows a front side view of a flat bottom hemp paper bag 130 in an upright position showing the bag with side gussets 132 and hemp paper twist handles 134 and 136, the bag having an inside patch (not shown) with a peel off hemp paper strip fully removed to seal the bag in a closed position 144.

Figure 8A:
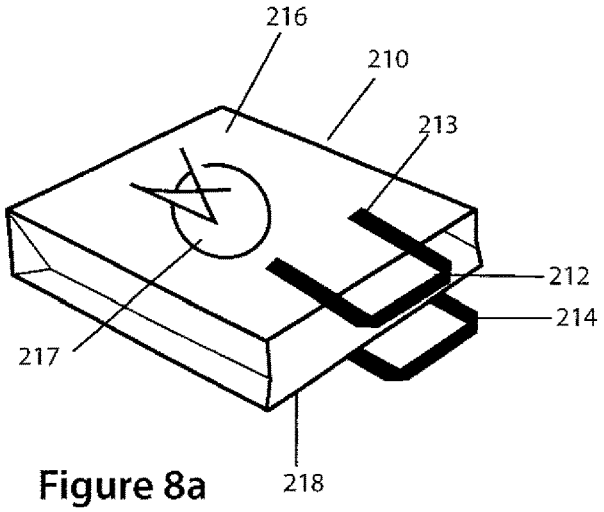
FIG. 8*a* is a top side view of a flat bottom hemp paper bag laid down on one side having the lower portion of hemp paper flat handles attached to the outside of the bag. The hemp paper flat handles are shown in the upward position.

FIG. 8*a* is a top side view of a flat bottom hemp paper bag 210 laid down on one side having the lower portion 213 of hemp paper flat handle 212 and lower portion (not shown) of hemp paper flat handle 214 attached to the outside 216 and 218 of the bag 210. The hemp paper flat handles 212 and 214 are shown in the upward position. A design or graphic 217 is seen on outside surface 216.

Figure 8B:
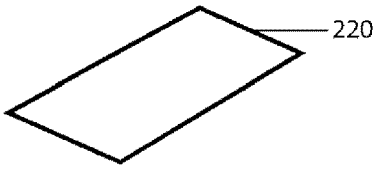
FIG. 8*b* is a side view of a hemp paper patch used to cover the lower portion of the hemp paper flat handle.

FIG. 8*b* is a side view of a hemp paper patch 220 used to cover the lower portion of the hemp paper flat handle.

Figure 8C:
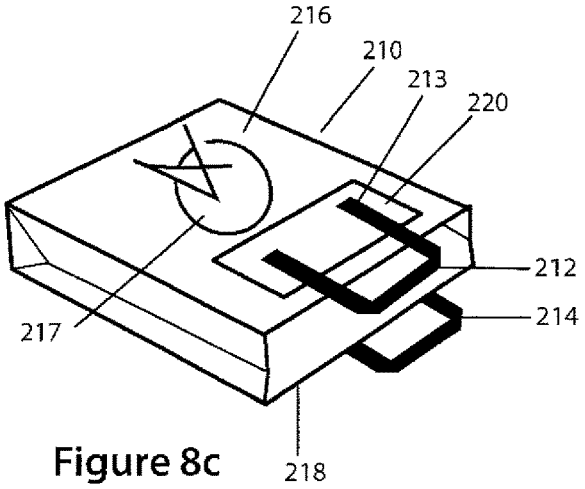
FIG. 8*c* is the flat bottom hemp paper bag of FIG. 8*a* having the hemp paper patch of FIG. 8*b* placed over the lower portion of the hemp paper flat handles of the bag. An internal view of the hemp paper patch shows the lower portion of hemp paper flat handle underneath the hemp paper patch. The hemp paper flat handles are in the upward position.

FIG. 8*c* is the flat bottom hemp paper bag 210 of FIG. 8*a* showing an internal view of the hemp paper patch 220 of FIG. 8*b* placed over the lower portion 213 of the hemp paper flat handle 212 and lower portion (not shown) of hemp paper flat handle 214 of the bag. An internal view of the hemp paper patch 220 shows the lower portion 213 of hemp paper flat handle 212 underneath the hemp paper patch 220. The hemp paper flat handles 212 and 214 are attached to the outside surface of the hemp paper bag 210 in the upward position.

Figure 8D:
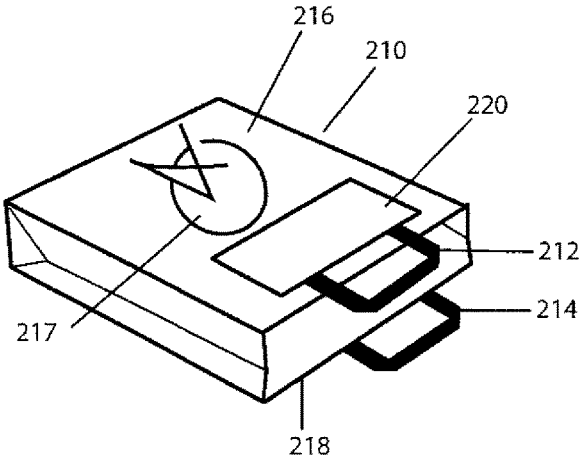
FIG. 8*d* is the flat bottom hemp paper bag of FIG. 8*a* having the hemp paper patch of FIG. 8*b* placed over the lower portion of the hemp paper flat handles of the bag. The hemp paper flat handles are in the upward position.

FIG. 8*d* is the flat bottom hemp paper bag 210 of FIG. 8*a* having the hemp paper patch 220 of FIG. 8*b* placed over the lower portion 213 (not shown) of the hemp paper flat handle 212 and lower portion (not shown) of hemp paper flat handle 214 of the bag 210. The hemp paper flat handles 212 and 214 are attached to the outside surface of the hemp paper bag 210 in the upward position.

Figure 9A:
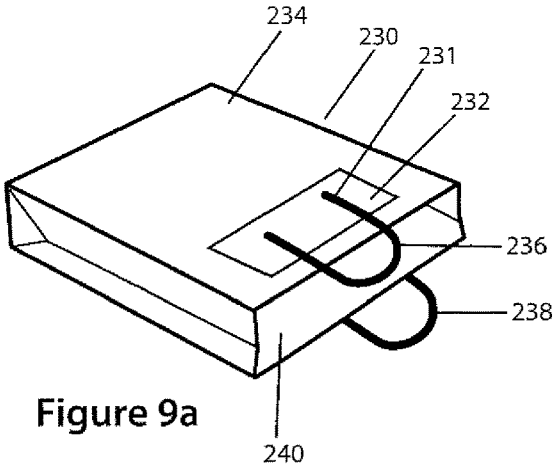
FIG. 9*a* is a top side view of a flat bottom hemp paper bag laid down on one side having a hemp paper patch attached to the outside surface of the bag and the lower portion of each hemp paper twist handle fastened to an attached hemp paper patch. The hemp paper twist handles are in the upward position.

FIG. 9*a* is a top side view of a flat bottom hemp paper bag 230 laid down on one side having a hemp paper patch 232 attached to the outside surface 234 of the bag 230 and the lower portion 231 of each hemp paper twist handle 236 and 238 (lower portion of hemp paper twist handle not shown) fastened to an attached hemp paper patch 232. The hemp paper twist handles 236 and 238 are in the upward position. The bag 230 has an opening 240.

Figure 9B:
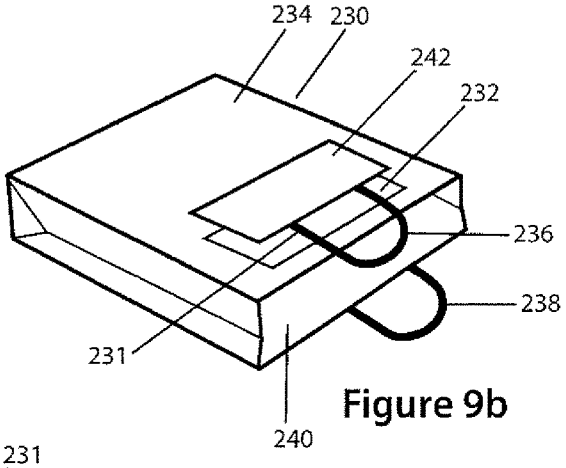
FIG. 9*b* shows the flat bottom hemp paper bag of FIG. 9*a* having a hemp paper patch attached to the outside surface of the bag and the lower portion of each hemp paper twist handle fastened to an attached hemp paper patch. A second hemp paper patch is located above the lower portion of each hemp paper twist handle to sandwich the lower portion of each hemp paper twist handle between the two hemp paper patches once the second hemp paper patch is attached. The hemp paper twist handles are in the upward position.

FIG. 9*b* shows the flat bottom hemp paper bag 230 of FIG. 9*a* having a hemp paper patch 232 attached to the outside surface 234 of the bag 230 and the lower portion 231 of each hemp paper twist handle 236 and 238 (lower portion of hemp paper twist handle not shown) fastened to an attached hemp paper patch 232. A second hemp paper patch 242 is located above the lower portion 231 of each hemp paper twist handle 236 and 238 (lower portion of hemp paper twist handle not shown) to sandwich the lower portion 231 of each hemp paper twist handle 236 and 238 between the two hemp paper patches 232 and 242 once the second hemp paper patch 242 is attached. The hemp paper twist handles 236 and 238 are in the upward position.

Figure 9C:
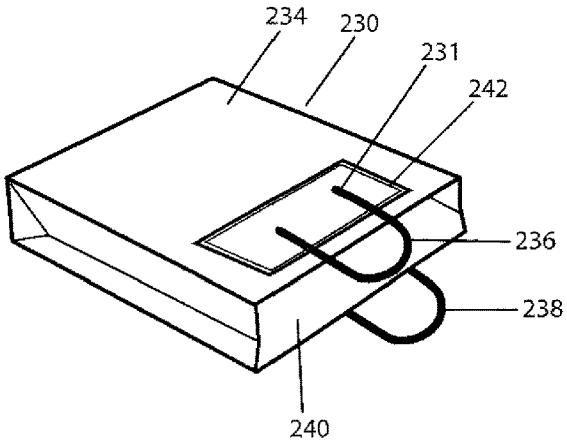
FIG. 9*c* shows the flat bottom hemp paper bag of FIG. 9*b* having a hemp paper patch attached to the outside surface of the bag and the lower portion of each hemp paper twist handle fastened to an attached hemp paper patch. A second hemp paper patch is then attached to the first hemp paper patch sandwiching the lower portion of each hemp paper twist handle in between the two patches. An internal view of the hemp paper patch shows the lower portion of the hemp paper twist handle underneath the hemp paper patch. The hemp paper twist handles are in the upward position.

FIG. 9*c* shows the flat bottom hemp paper bag 230 of FIG. 9*b* having a hemp paper patch 232 attached (not shown) to the outside surface 234 of the bag 230 and the lower portion 231 of each hemp paper twist handle 236 and 238 (lower portion of hemp paper twist handle not shown) fastened to an attached hemp paper patch 232 (not shown). A second hemp paper patch 242 is then attached to the first hemp paper patch 232 (not shown) sandwiching the lower portion 231 of each hemp paper twist handle 236 and 238 in between the two patches 232 and 242. An internal view of the hemp paper patch 242 shows the lower portion of the hemp paper twist handle 231 underneath the hemp paper patch 242. The hemp paper twist handles 236 and 238 are in the upward position.

Figure 9D:
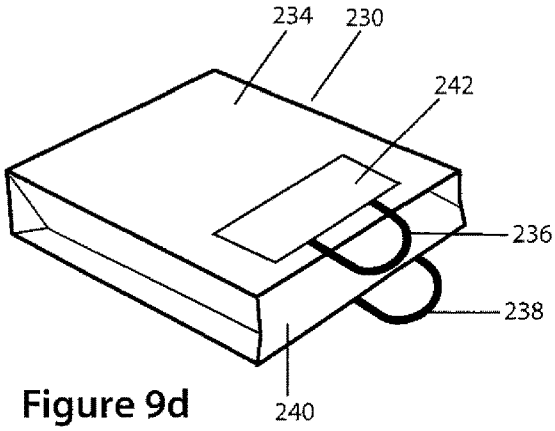
FIG. 9*d* shows the flat bottom hemp paper bag of FIG. 9*c* having a hemp paper patch attached to the outside surface of the bag and the lower portion of each hemp paper twist handle fastened to an attached hemp paper patch. A second hemp paper patch is attached to the first hemp paper patch sandwiching the lower portion of each hemp paper twist handle in between the two patches. The hemp paper twist handles are in the upward position.

FIG. 9*d* shows the flat bottom hemp paper bag 230 of FIG. 9*c* having a hemp paper patch 232 (not shown) attached to the outside surface 234 of the bag 230 and the lower portion 231 (not shown) of each hemp paper twist handle 236 and 238 fastened to an attached hemp paper patch 232 (not shown). A second hemp paper patch 242 is attached to the first hemp paper patch 232 (not shown) sandwiching the lower portion 231 of each hemp paper twist handle 236 and 238 in between the two patches 232 and 242. The hemp paper twist handles 236 and 238 are in the upward position.

FIG. 10*a* shows the lower portion 252 of a hemp paper flat handle 254 attached to a hemp paper patch 250, wherein the hemp paper flat handle 254 is in the upward position. FIG. 10*b* shows the lower portion 252 of a hemp paper flat handle 254 attached to a hemp paper patch 250, and a second hemp paper patch 256 attached to the first hemp paper patch 250, wherein the lower portion 252 of the hemp paper flat handle 254 is sandwiched between the first hemp paper patch 250 and second hemp paper patch 256. The hemp paper flat handle 254 is in the upward position.

FIG. 10*c* shows the hemp paper patch 256 and the hemp paper flat handle 254 of FIG. 10*b* wherein the hemp paper flat handle 254 is in the downward position.

FIG. 10*d* shows the hemp paper patch 256 and hemp paper flat handle 254 of FIG. 10*c* showing an internal view of the hemp paper patch 256, that shows the lower portion 252 of the hemp paper flat handle 254 sandwiched between the two hemp paper patches 250 (not shown) and 256 and the hemp paper flat handle 254 in the downward position.

FIG. 10*e* shows a flat bottom hemp paper bag 260 laid down on one side, showing an internal view of the bag 260 with the hemp paper patch 256 and hemp paper flat handle 254 of FIG. 10*d* attached to the bottom inside surface 262 of the bag 260. The lower portion 264 of the hemp paper flat handle 254 is in the downward position.

FIG. 10*f* shows a flat bottom hemp paper bag 260 laid down on one side, showing an internal view of the bag 260 with the hemp paper patch 256 and hemp paper flat handle 254 of FIG. 10*d* attached on both the top and bottom inside surface 262 and 272 of the bag 260. The upper portion of the hemp paper flat handles 254 and 270 are in the downward position. On the top side of the paper bag 260 is hemp paper patch 268, lower portion of handle 266 and upper portion of handle 270.

FIG. 10*g* shows a flat bottom hemp paper bag 260 laid down on one side, with the bag 260 wide open, showing the lower portion of a hemp paper flat handle 254 sandwiched between two hemp paper patches 250 (not shown) and 256 that are attached to the bottom inside surface 272 of the bag 260. The upper portion of the hemp paper flat handle 254 is in the downward position.

FIG. 10*h* shows a flat bottom hemp paper bag 260 in an upright position showing an inside hemp paper patch 290 attached to the inside surface 296 of the bag 260 with the lower portion 292 (not shown) of the hemp paper flat handle 294 underneath the hemp paper patch 290. The hemp paper flat handle 294 is in the downward position.

Figure 11B:
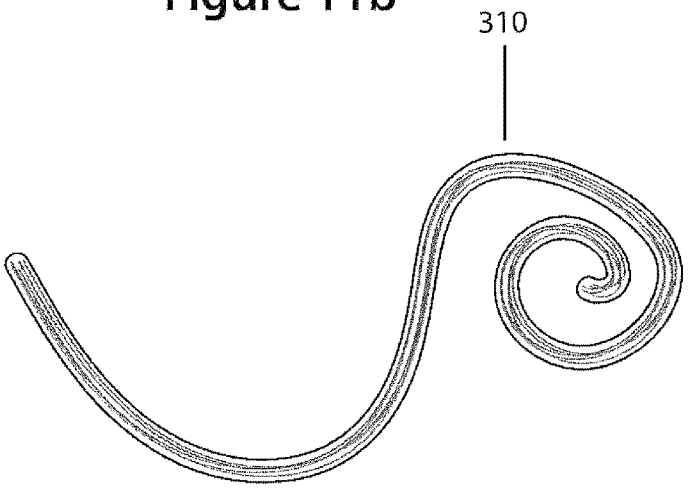
FIG. 11*b* shows the internal material other than hemp that will be covered by a hemp paper twist handle.
Figure 11D:
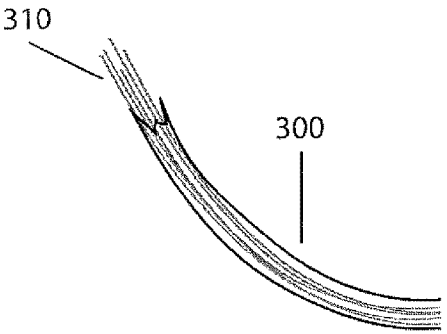
FIG. 11*d* shows an internal view of hemp paper twist handle material that enrobes material other than hemp such as nylon.
Figure 11A:
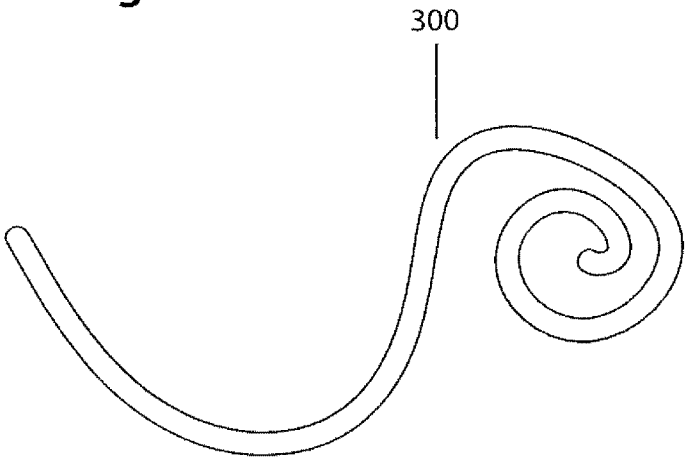
FIG. 11*a* shows the outside material used to make a hemp paper twist handle.

FIG. 11*a* shows the external material 300 used to make a hemp paper twist handle.

FIG. 11*b* shows an internal material 310 other than hemp that will be covered by a hemp paper twist handle.

Figure 11C:
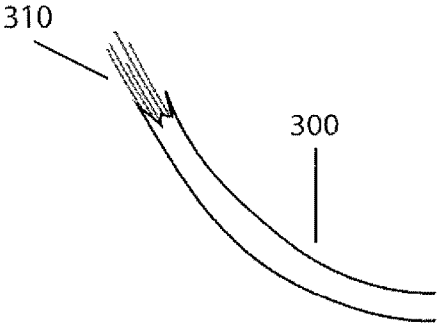
FIG. 11*c* shows hemp paper twist handle material that enrobes material other than hemp such as nylon.

FIG. 11*c* shows hemp paper twist handle material 300 that enrobes material other than hemp 310 such as nylon.

FIG. 11*d* shows an internal view of hemp paper twist handle material 300 that enrobes material 310 other than hemp such as nylon.

Figure 12B:
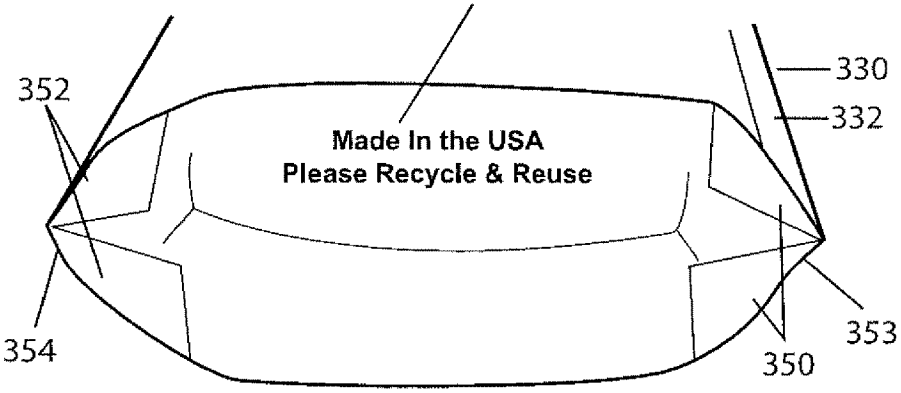
FIG. 12*b* is a bottom view of a flat bottom hemp paper bag, the bottom view showing printed graphics or design. The bottom view shows bag construction with an elliptical shape that has rounded corners at opposite edges.
Figure 12A:
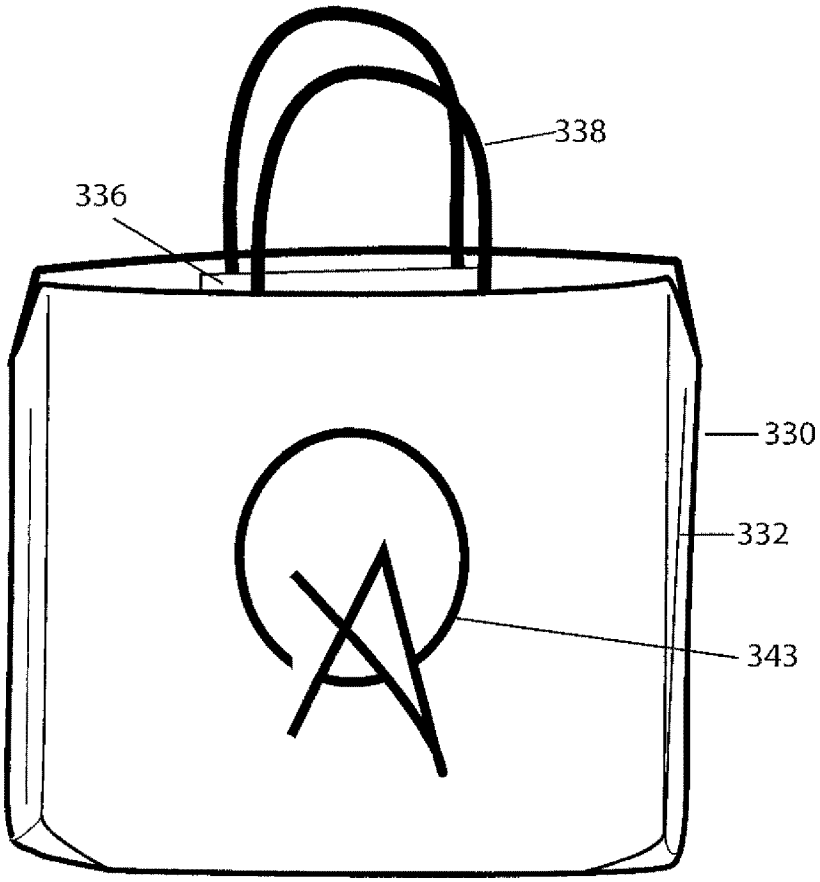
FIG. 12*a* is a front view of a flat bottom hemp paper bag with hemp paper twist handles, the bag showing printed graphics or design.

FIG. 12*a* is a front view of a flat bottom hemp paper bag 330 with side gussets 332 and with the lower portion of hemp paper twist handles 338 underneath an attached inside hemp paper patch 336, the bag showing printed graphics or design 343.

FIG. 12*b* is a bottom view of a flat bottom hemp paper bag 330 with side gussets 332, the bottom view showing printed graphics or information 340. The bottom view shows bag construction with an elliptical shape that has opposite flat bottom edges 350 and 352 and opposite rounded corners 353 and 354.

Figure 13C:
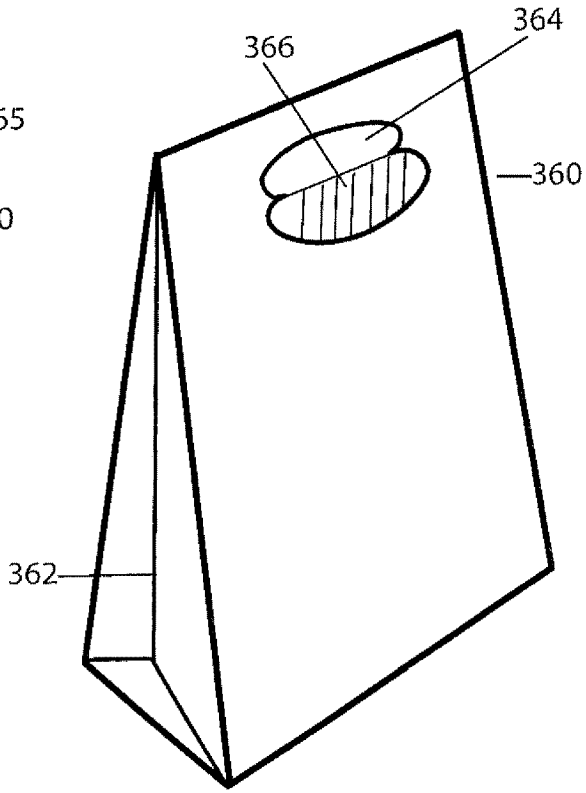
FIG. 13*c* shows a front side view of a flat bottom hemp paper bag in an upright position showing the bag with side gussets and die cut handles in a closed position.
Figure 13B:
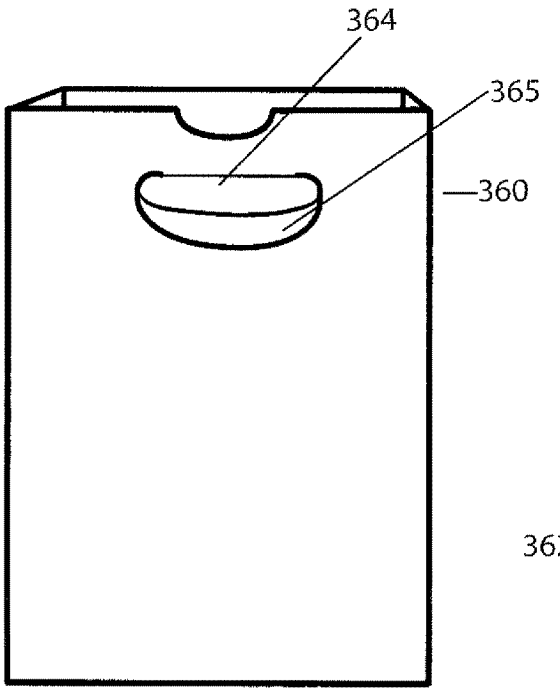
FIG. 13*b* shows a front view of a flat bottom hemp paper bag in an upright position showing the bag with die cut handles in an open position.
Figure 13A:
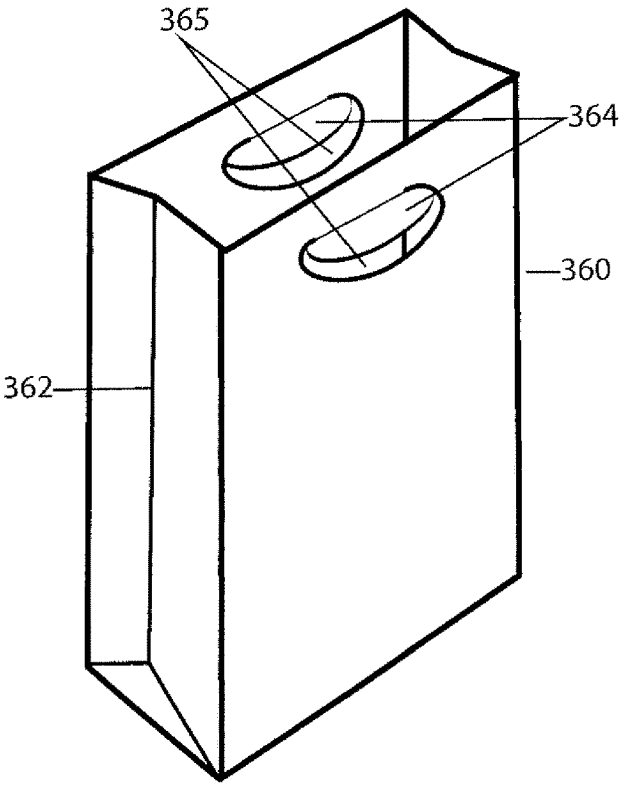
FIG. 13*a* shows a front side view of a flat bottom hemp paper bag in an upright position showing the bag with side gussets and die cut handles in an open position.

FIG. 13*a* shows a side view of a flat bottom hemp paper bag 360 in an upright position showing the bag with side gussets 362 and die cut opening 365 with die cut handles 364 in an open position.

FIG. 13*b* shows a front view of a flat bottom hemp paper bag 360 in an upright position showing the bag with die cut opening 365 with die cut handle 364 in an open position.

FIG. 13*c* shows a side view of a flat bottom hemp paper bag 360 in an upright position showing the bag with side gussets 362 and die cut handles 364 in a closed position 366.

Figure 14A:
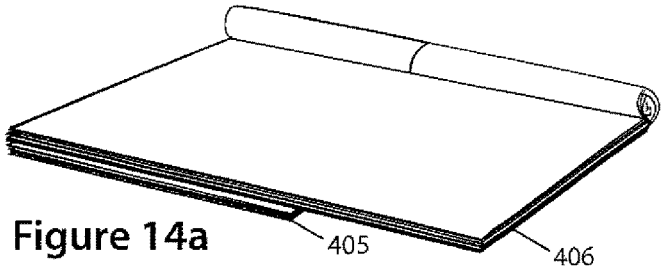
FIG. 14*a* shows two stacks of different size precut hemp paper newsprint sheets with the larger size precut hemp paper newsprint sheets placed on top of the smaller size precut hemp paper newsprint sheets and the precut hemp paper newsprint sheets beginning to be rolled together.

FIG. 14*a* shows two stacks of different size precut hemp paper newsprint sheets 405 and 406 with the larger precut hemp paper newsprint sheets 406 placed on top of the smaller precut hemp paper newsprint sheets 405 and the sheets 406 and 405 beginning to be rolled together.

Figure 14B:
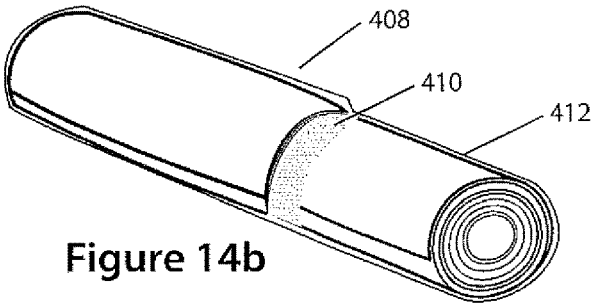
FIG. 14*b* shows groups of precut hemp paper newsprint sheets of different lengths rolled together with a colored piece of paper in between the two sizes in a single cylindrical shape, the two groups of precut hemp paper newsprint sheets shrink wrapped together.

FIG. 14*b* shows groups of precut hemp paper newsprint sheets of different lengths of FIG. 14*a* rolled together with a colored piece of paper 410 in between the two sizes in a single cylindrical shape 408, the two groups of precut hemp paper newsprint sheets shrink wrapped 412 together.

Figure 14C:
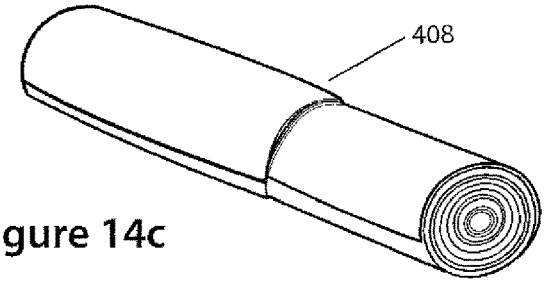
FIG. 14*c* shows groups of precut hemp paper newsprint sheets of different lengths rolled together in a single cylindrical shape.

FIG. 14*c* shows groups of precut hemp paper newsprint sheets of different lengths of FIG. 14*a* rolled together in a single cylindrical shape 408, with no shrink wrap.

Figure 14D:
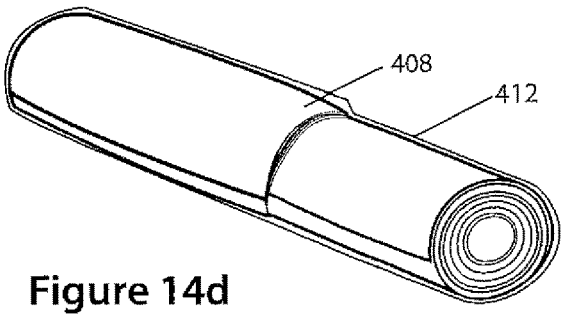
FIG. 14*d* shows groups of precut hemp paper newsprint sheets of different lengths of FIG. 14*c* rolled together in a cylindrical shape and shrink wrapped.

FIG. 14*d* shows groups of precut hemp paper newsprint sheets of different lengths of FIG. 14*c* rolled together in a cylindrical shape 408 and shrink wrapped 412.

Figure 14E:
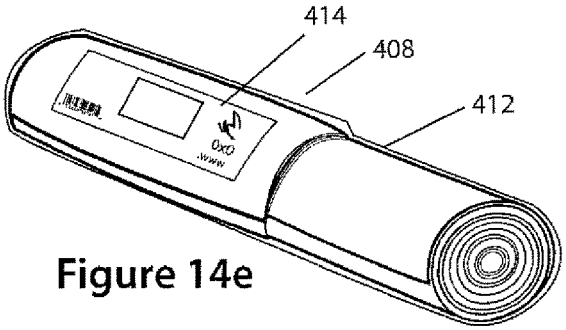
FIG. 14*e* shows groups of precut hemp paper newsprint sheets of different lengths rolled together in a cylindrical shape and shrink wrapped of FIG. 14*d* having a label affixed to the shrink wrap.

FIG. 14*e* shows groups of precut hemp paper newsprint sheets of different lengths of FIG. 14*c* rolled together in a cylindrical shape 408 and shrink wrapped 412 together, the shrink wrap having a label affixed to the outside of the shrink wrap showing printed graphics or design 414.

The invention claimed is:

1. A paper bag comprising:

hemp paper;

said hemp paper having a tensile MD strength from five pounds to two hundred pounds per inch;

said hemp paper having a tensile CD strength from five pounds to two hundred pounds per inch;

said hemp paper having a bursting strength from five pounds to two hundred pounds per square inch;

said hemp paper comprising one hundred percent hemp.

2. The paper bag of claim 1 wherein said hemp paper is treated or coated with AKD sizing, a wax derivative.

3. The paper bag of claim 1 wherein said paper bag is a flat bottom paper bag.

4. The paper bag of claim 3 wherein said flat bottom bag comprises a tubular envelope at one end by glued flaps that form a flat bottom.

5. The paper bag of claim 1 wherein said paper bag comprises gussets.

6. The paper bag of claim 1 wherein said paper bag comprises an opening and a closure mechanism for said opening.

7. The paper bag of claim 1 further comprising a twist handle or flat handle, paper in said flat handle folded twice, said twice folded paper bent in a first and second corner to form said flat handle.

8. The paper bag of claim 7 wherein said twist handle or said flat handle comprises hemp paper.

9. The paper bag of claim 7 further comprising a single or double patch affixed to said bag and attached to said twist handle or said flat handle.

10. The paper bag of claim 1 further comprising a die cut handle.

11. The paper bag of claim 1 wherein said hemp paper is oil and grease resistant, leakproof, water resistant or a combination of same.

12. The paper bag of claim 1 wherein said paper bag is printable, allowing ink and graphics to be attached to the paper.

13. The paper bag of claim 1 wherein said paper bag is recyclable, compostable, biodegradable or any combination.

14. The bag of claim 1 wherein said paper bag has a width between three inches and twenty inches, height between four inches and twenty inches and a basis weight ranging from ten pounds to sixty pounds.

15. The paper bag of claim 1, wherein said paper bag is certified to be food safe.

16. The paper bag of claim 1 wherein said paper bag is sealable, resealable or closeable.

* * * * *